US009204500B2

(12) United States Patent
Ikeda et al.

(10) Patent No.: US 9,204,500 B2
(45) Date of Patent: Dec. 1, 2015

(54) MICROWAVE HEATING APPARATUS AND PROCESSING METHOD

(71) Applicant: TOKYO ELECTRON LIMITED, Tokyo (JP)

(72) Inventors: Taro Ikeda, Yamanashi (JP); Shigeru Kasai, Yamanashi (JP); Jun Yamashita, Yamanashi (JP); Masakazu Ban, Yamanashi (JP)

(73) Assignee: TOKYO ELECTRON LIMITED, Tokyo (JP)

( * ) Notice: Subject to any disclaimer, the term of this patent is extended or adjusted under 35 U.S.C. 154(b) by 421 days.

(21) Appl. No.: 13/727,000

(22) Filed: Dec. 26, 2012

(65) Prior Publication Data

US 2013/0168390 A1 Jul. 4, 2013

(30) Foreign Application Priority Data

Dec. 28, 2011 (JP) ..... 2011-289024
Aug. 14, 2012 (JP) ..... 2012-179802

(51) Int. Cl.

*H05B 6/64* (2006.01)
*H05B 6/72* (2006.01)
*H05B 6/74* (2006.01)
*H05B 6/80* (2006.01)
*H05B 6/70* (2006.01)

(52) U.S. Cl.

CPC ..... *H05B 6/6402* (2013.01); *H05B 6/70* (2013.01); *H05B 6/806* (2013.01); *H05B 6/6426* (2013.01); *H05B 6/707* (2013.01); *H05B 6/72* (2013.01)

(58) Field of Classification Search

CPC ..... H05B 6/64; H05B 6/707; H05B 6/72; H05B 6/6402; H05B 6/6426; H05B 6/62; H05B 6/705; H05B 6/78

USPC ..... 219/745, 746, 748, 749, 750, 756, 761, 219/770, 695, 696, 697

See application file for complete search history.

(56) References Cited

U.S. PATENT DOCUMENTS

| | | | | | |
|---|---|---|---|---|---|
| 3,366,769 | A | * | 1/1968 | Lima | 219/748 |
| 3,373,259 | A | * | 3/1968 | Smith | 219/746 |
| 3,748,421 | A | * | 7/1973 | Peterson | 219/756 |
| 4,284,868 | A | * | 8/1981 | Simpson | 219/749 |
| 4,455,135 | A | * | 6/1984 | Bitterly | 432/1 |
| 4,463,239 | A | * | 7/1984 | Miller | 219/749 |
| 4,631,380 | A | * | 12/1986 | Tran | 219/697 |
| 4,795,871 | A | * | 1/1989 | Strattan et al. | 219/707 |
| 5,874,715 | A | * | 2/1999 | Choi | 219/746 |
| 2004/0001295 | A1 | * | 1/2004 | Kumar et al. | 361/115 |

FOREIGN PATENT DOCUMENTS

| | | |
|---|---|---|
| JP | 62-268086 | 11/1987 |
| JP | 6-17190 | 3/1994 |

* cited by examiner

*Primary Examiner* — Dana Ross
*Assistant Examiner* — Hemant Mathew
(74) *Attorney, Agent, or Firm* — Oblon, McClelland, Maier & Neustadt, L.L.P.

(57) ABSTRACT

In the microwave heating apparatus, four microwave introduction ports are arranged at positions spaced apart from each other at an angle of about 90° in a ceiling portion of a processing chamber in such a way that the long sides and the short sides thereof are in parallel to inner surfaces of four sidewalls. The microwave introduction port are disposed in such a way that each of the microwave introduction ports are not overlapped with another microwave introduction port whose long sides are in parallel to the long sides of the corresponding microwave introduction port when the corresponding microwave introduction port is moved in translation in a direction perpendicular to the long sides thereof.

9 Claims, 16 Drawing Sheets

| | |
|---|---|
| ARRANGEMENT |  |
| ELECTROMAGNETIC WAVE VOLUME LOSS DENSITY IN SURFACE OF WAFER |  |
| S11 | 0.44 |
| S21 | 0.14 |
| S31 | 0.23 |
| S41 | 0.12 |
| ENTIRE AREA | $3.33 \times 10^5$ mm$^2$ |
| Aw | 37.4% |
| Pw | 2159W |

| | |
|---|---|
| ARRANGEMENT |  |
| ELECTROMAGNETIC WAVE VOLUME LOSS DENSITY IN SURFACE OF WAFER |  |
| S11 | 0.61 |
| S21 | 0.04 |
| S31 | 0.22 |
| S41 | 0.04 |
| ENTIRE AREA | $4.29 \times 10^5$ mm$^2$ |
| Aw | 29.8% |
| Pw | 1729W |

| | |
|---|---|
| ARRANGEMENT |  |
| ELECTROMAGNETIC WAVE VOLUME LOSS DENSITY IN SURFACE OF WAFER |  |
| S11 | 0.25 |
| S21 | 0.04 |
| S31 | 0.17 |
| S41 | 0.03 |
| ENTIRE AREA | $3.23 \times 10^5$ mm$^2$ |
| Aw | 38.4% |
| Pw | 2718W |

MICROWAVE HEATING APPARATUS AND PROCESSING METHOD

CROSS-REFERENCE TO RELATED APPLICATIONS

This application claims priority to Japanese Patent Application Nos. 2011-289024 and 2012-179802 filed on Dec. 28, 2011 and Aug. 14, 2012, respectively, the entire contents of which are incorporated herein by reference.

FIELD OF THE INVENTION

The present invention relates to a microwave heating apparatus for performing a predetermined process by introducing microwaves into a processing chamber and a processing method for heating a target object to be processed by using the microwave heating apparatus.

BACKGROUND OF THE INVENTION

As an LSI device or a memory device is miniaturized, a depth of a diffusion layer in a transistor manufacturing process is decreased. Conventionally, doping atoms implanted into the diffusion layer are activated by a high-speed heating process referred to as an RTA (Rapid Thermal Annealing) using a lamp heater. However, in the RTA process, as the diffusion of the doping atoms progresses, the depth of the diffusion layer exceeds a tolerable range, and this makes the miniaturized design difficult. Since the depth of the diffusion layer is incompletely controlled, the electrical characteristics of devices deteriorate. For example, a problem such as occurrence of leakage current or the like is generated.

Recently, an apparatus using microwaves has been suggested as an apparatus for heating a semiconductor wafer. When doping atoms are activated by microwave heating, a microwave directly acts on the doping atoms. Hence, excessive heating does not occur, and the diffusion of the diffusion layer can be suppressed.

As for the heating apparatus using microwaves, a microwave heating apparatus in which a specimen is heated by introducing microwaves into a pyramid-shaped horn through a rectangular waveguide is suggested in, e.g., Japanese Patent Application Publication No. S62-268086. In this reference, the rectangular waveguide and the pyramid-shaped horn are arranged at an angle of about 45° in an axial direction, so that two orthogonally polarized microwaves in a $TE_{10}$ mode can be radiated to the specimen at the same phase.

In Japanese Utility Model Application Publication No. H6-17190, a microwave heating apparatus including a heating chamber having a square cross section whose size is set to about $\lambda/2$ to $\lambda$ of a free space wavelength of the introduced microwaves is suggested as a heating apparatus for bending a heating target object.

When doping atoms are activated by microwave heating, it is required to supply a power larger than a certain level. Accordingly, microwaves may efficiently be introduced into a processing chamber by providing a plurality of microwave introduction ports. When a plurality of microwave introduction ports is provided, microwaves introduced from one of the microwave introduction ports may enter another microwave introduction port, thereby deteriorating power usage efficiency and heating efficiency In the case of microwave heating, the microwaves are directly irradiated to a semiconductor wafer disposed immediately below the microwave introduction ports, so that the surface of the semiconductor wafer is not uniformly heated.

SUMMARY OF THE INVENTION

In view of the above, the present invention provides a microwave heating apparatus and a processing method which are capable of uniformly processing a target object while improving power use efficiency and heating efficiency.

In accordance with an aspect of the present invention, there is provided a microwave heating apparatus including a processing chamber configured to accommodate a target object to be processed, the processing chamber having therein a microwave irradiation space; and a microwave introducing unit configured to introduce microwaves for heating the target object into the processing chamber.

The processing chamber includes a top wall, a bottom wall and four sidewalls connected to one another; the microwave introducing unit includes a first to a fourth microwave source; the top wall has a first to a fourth microwave introduction port through which the microwaves generated by the first to the fourth microwave source are introduced into the processing chamber; each of the first to the fourth microwave introduction port is of a substantially rectangular shape having long sides and short sides in a plan view, and the microwave introduction ports are arranged in such a way that the long sides and the short sides thereof are in parallel to inner surfaces of the four sidewalls; and the microwave introduction port are disposed at positions spaced apart from each other at an angle of about 90° in such a way that each of the microwave introduction ports are not overlapped with another microwave introduction port whose long sides are in parallel to the long sides of the corresponding microwave introduction port when the corresponding microwave introduction port is moved in translation in a direction perpendicular to the long sides thereof.

A ratio $L_1/L_2$ between a long side $L_1$ and a short side $L_2$ of each of the microwave introduction ports may be set to about 4 or more.

The first to the fourth microwave introduction port may be arranged such that central axes thereof parallel to the long sides of adjacent two of the microwave introduction ports are perpendicular to each other and central axes of two of the microwave introduction ports which are not adjacent to each other is not overlapped with each other on a same straight line.

The microwave radiation space may be defined by the top wall, the four sidewalls and a partition provided between the top wall and the bottom wall, and an inclined portion for reflecting the microwaves toward the target object is provided at the partition.

The inclined portion may have an inclined surface having a position higher than a reference position corresponding to the height of the target object and a position lower than the reference position, and may be disposed to surround the target object.

The microwave introducing unit may include one or more waveguides through which microwaves are transmitted toward the processing chamber; and one or more adaptor members attached to an outer side of the top wall of the processing chamber, each of the adaptor members being formed of a plurality of metallic block bodies, wherein each of the adaptor members includes therein a substantially S-shaped waveguide path through which the microwaves are transmitted. In this case, the waveguide paths may have one ends connected to the waveguides and the other ends connected to the microwave introduction ports such that the waveguides are not vertically overlapped with all or some of the microwave introduction ports.

In accordance with another aspect of the present invention, there is provided a processing method for heating a target object to be processed by using a microwave heating apparatus including: a processing chamber configured to accommodate the target object, the processing chamber having therein a microwave irradiation space; and a microwave introducing unit configured to introduce microwaves for heating the target object into the processing chamber.

The processing chamber includes a top wall, a bottom wall and four sidewalls connected to one another; the microwave introducing unit includes a first to a fourth microwave source; the top wall has a first to a fourth microwave introduction port through which the microwaves generated by the first to the fourth microwave source are introduced into the processing chamber; each of the first to the fourth microwave introduction port is of a substantially rectangular shape having long sides and short sides in a plan view, and the microwave introduction ports are disposed in such a way that the long sides and the short sides thereof are in parallel to inner surfaces of the four sidewalls; and the microwave introduction port are disposed at positions spaced apart from each other at an angle of about 90° in such a way that each of the microwave introduction ports are not overlapped with another microwave introduction port whose long sides are in parallel to the long sides of the corresponding microwave introduction port when the corresponding microwave introduction port is moved in translation in a direction perpendicular to the long sides thereof.

In the microwave heating apparatus and the processing method in accordance with the aspects of the present invention, the loss of the microwaves radiated into the processing chamber is reduced, so that the power use efficiency and the heating efficiency can be improved. Further, the target object can be uniformly heated.

BRIEF DESCRIPTION OF THE DRAWINGS

The objects and features of the present invention will become apparent from the following description of embodiments, given in conjunction with the accompanying drawings, in which.

DETAILED DESCRIPTION OF THE EMBODIMENTS

Hereinafter, embodiments of the present invention will be described with reference to the accompanying drawings.

First Embodiment

Figure 1:
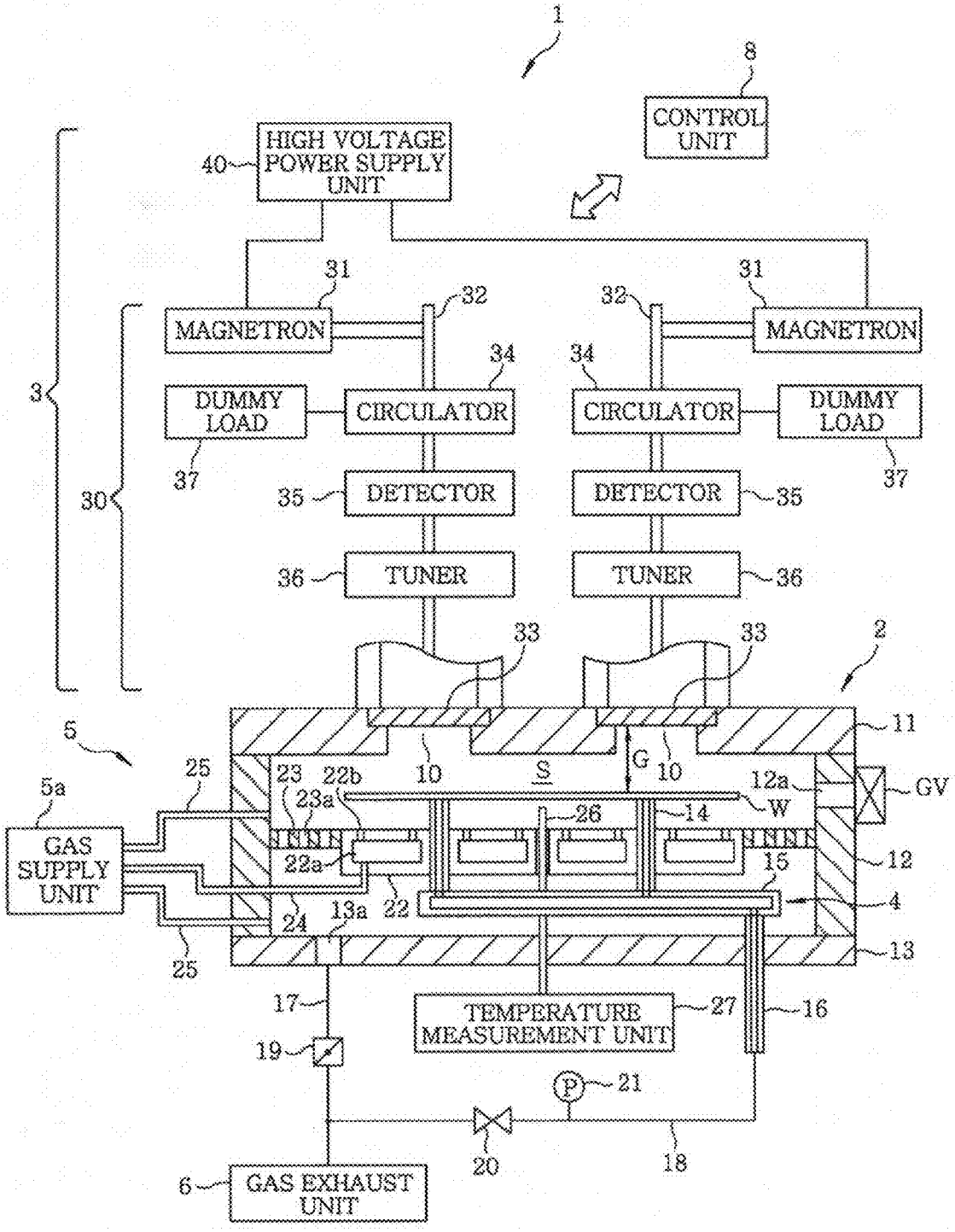
FIG. 1 is a cross sectional view showing a schematic configuration of a microwave heating apparatus in accordance with a first embodiment of the present invention.

First, a schematic configuration of a microwave heating apparatus in accordance with a first embodiment of the present invention will be described with reference to FIG. 1. FIG. 1 is a cross sectional view showing a schematic configuration of the microwave heating apparatus in accordance with the present embodiment. The microwave heating apparatus 1 of the present embodiment performs an annealing process by irradiating microwaves to, e.g., a semiconductor wafer (hereinafter, simply referred to as "wafer") for manufacturing semiconductor devices through a series of consecutive operations.

The microwave heating apparatus 1 includes: a processing chamber 2 accommodating a wafer W as a target object to be processed; a microwave introducing unit 3 for introducing microwaves into the processing chamber 2; a supporting unit 4 for supporting a wafer W in the processing chamber 2; a gas supply mechanism 5 for supplying a gas into the processing chamber 2; a gas exhaust unit 6 for vacuum-exhausting the processing chamber 2; and a control unit 8 for controlling the respective components of the microwave heating apparatus 1.

<Processing Chamber>

The processing chamber 2 is made of a metal material, such as aluminum, aluminum alloy, stainless steel or the like, for example. The microwave introducing unit 3 is provided above the processing chamber 2 to introduce electromagnetic waves (microwaves) into the processing chamber 2. The configuration of the microwave introducing unit 3 will be described in detail later.

The processing chamber 2 has a hollow inside and includes a plate-shaped ceiling portion 11 serving as a top wall; a bottom portion 13 serving as a bottom wall; four sidewall portions 12 serving as sidewalls for connecting the ceiling portion 11 and the bottom portion 13; a plurality of microwave introduction ports 10 vertically extending through the ceiling portion 11; a loading/unloading port 12*a* provided at a corresponding sidewall portion 12; and a gas exhaust port 13*a* provided at the bottom portion 13. Here, the four sidewall portions 12 form a square column shape having horizontal cross sections that are connected to one another at a right angle. Therefore, the processing chamber 2 has a cubical shape including a space therein. The inner surfaces of the sidewall portions 12 are preferably flat and serve as reflective surfaces for reflecting microwaves.

The processing chamber 2 may be fabricated by machining. In that case, it is practically difficult to form the angled parts, i.e., the parts where one of the sidewall portions 12 are brought into contact with another sidewall portion or the parts where the sidewall portions 12 and the bottom portion 13 are brought into contact with each other, at a right angle. Thus, the corner parts may be rounded. A simulation result shows that, when the rounding process is performed, it is preferable to set the radius of curvature "Rc" within the range from about 15 mm to 16 mm in order to suppress reflection by the microwave introduction ports 10 (see FIGS. 9D and 9E). The loading/unloading port 12*a* is used for loading and unloading the wafer W with respect to a transfer chamber (not shown) adjacent to the processing chamber 2.

A gate valve "GV" is provided between the processing chamber 2 and the transfer chamber. The gate valve GV serves to open and close the loading/unloading port 12*a*. When the gate valve GV is closed, the processing chamber 2 is airtightly sealed. When the gate valve GV is opened, the wafer W can be transferred between the processing chamber 2 and the transfer chamber.

<Supporting Unit>

The supporting unit 4 includes a plate-shaped hollow lift plate 15 provided in the processing chamber 2; a plurality of tube-shaped supporting pins 14 extending upward from a top surface of the lift plate 15; and a tube-shaped shaft 16 extending from a bottom surface of the lift plate 15 to the outside of the processing chamber 2 through the bottom portion 13. The shaft 16 is fixed to an actuator (not shown) outside of the processing chamber 2.

The supporting pins 14 serves to contact with the wafer W and support the wafer W in the processing chamber 2. The upper portions of the supporting pins 14 are arranged along the circumferential direction of the wafer W. Further, the supporting pins 14, the lift plate 15 and the shaft 16 are configured such that the wafer W can be vertically displaced by the actuator.

The supporting pins 14, the lift plate 15 and the shaft 16 are configured such that the wafer W can be attracted onto the supporting pins 14 by the gas exhaust unit 6. Specifically, each of the supporting pins 14 and the shaft 16 has a tube shape communicating with the inner space of the lift plate 15. Further, suction holes for sucking the bottom surface of the wafer W are formed at the upper portions of the supporting pins 14.

The supporting pins 14 and the lift plate 15 are made of a dielectric material, e.g., quartz, ceramic or the like.

<Gas Exhaust Unit>

The microwave heating apparatus 1 further includes a gas exhaust line 17 for connecting a gas exhaust port 13*a* and the gas exhaust unit 6; a gas exhaust line 18 for connecting the shaft 16 and the gas exhaust line 17; a pressure control valve 19 disposed on the gas exhaust line 17, and an opening/closing valve 20 and a pressure gauge 21 which are disposed on the gas exhaust line 18. The gas exhaust line 18 is directly or indirectly connected to the shaft 16 so as to communicate with the inner space of the shaft 16. The pressure control vale 19 is provided between the gas exhaust port 13*a* and the connection node of the gas exhaust lines 17 and 18.

The gas exhaust unit 6 has a vacuum pump such as a dry pump or the like. By operating the vacuum pump of the gas exhaust unit 6, the inner space of the processing chamber 2 is vacuum-exhausted. At this time, by opening the opening/closing valve 20, the bottom surface of the wafer W is sucked, so that the wafer W is attracted and fixed to the supporting pins 14. Further, a gas exhaust equipment provided at a facility where the microwave heating apparatus 1 is installed may be used instead of the vacuum pump of the gas exhaust unit 6.

<Gas Introducing Mechanism>

As described above, the microwave heating apparatus 1 includes the gas supply mechanism 5 for supplying a gas into the processing chamber 2. The gas supply mechanism 5 includes a gas supply unit 5*a* provided with a gas supply source (not shown); a shower head 22 provided below a position where the wafer W is to be disposed in the processing chamber 2; a substantially quadrilateral frame-like rectifying plate 23 arranged between the shower head 22 and the sidewall portions 12; a line 24 for connecting the shower head 22 and the gas supply unit 5*a*; and a plurality of lines 25, connected to the gas supply unit 5*a*, for introducing a processing gas into the processing chamber 2. The shower head 22 and the rectifying plate 23 are made of a metal material, e.g., aluminum, aluminum alloy, stainless steel or the like.

The shower head 22 serves to cool the wafer W by using a cooling gas in the case of performing a relatively low temperature process on the wafer W. The shower head 22 includes a gas channel 22*a* communicating with the line 24; and a plurality of gas injection holes 22*b* communicating with the gas channel 22*a* to inject a cooling gas toward the wafer W. In the example shown in FIG. 1, the gas injection holes 22*b* are formed at the top surface of the shower head 22. The shower head 22 is not a necessary component of the microwave heating apparatus 1 and thus may not be provided.

The rectifying plate 23 has a plurality of rectifying openings 23*a* vertically extending through the rectifying plate 23. The rectifying plate 23 serves to allow a gas to flow toward the gas exhaust port 13*a* while rectifying an atmosphere at a location where the wafer W is to be disposed in the processing chamber 2. The rectifying plate 23 is not a necessary component of the microwave heating apparatus 1 and thus may not be provided.

The gas supply unit 5*a* is configured to supply a processing gas or a cooling gas, e.g., $N_2$, Ar, He, Ne, $O_2$, $H_2$ or the like. Further, as for a unit for supplying a gas into the processing chamber 2, an external gas supply unit that is not included in the configuration of the microwave heating apparatus 1 may be used instead of the gas supply unit 5*a*.

The microwave heating apparatus 1 includes mass flow controllers (not shown) and opening/closing valves (not shown) disposed on the lines 24 and 25. Types of gases to be supplied into the shower head 22 and the processing chamber 2, and the flow rates thereof are controlled by the mass flow controllers and the opening/closing valves.

<Microwave Radiation Space>

In the microwave heating apparatus 1 of the present embodiment, a microwave radiation space "S" is formed of a space defined by the ceiling portion 11, the four sidewall portions 12, the shower head 22 and the rectifying plate 23 in the processing chamber 2. Microwaves are radiated into the microwave radiation space S through a plurality of microwave introduction ports 10 provided at the ceiling portion 11. Here, the shower head 22 and the rectifying plate 23 also serve as partitioning portions for defining the lower side of the microwave radiation space S in the processing chamber 2. Since each of the ceiling portion 11, the four sidewall portions 12, the shower head 22 and the rectifying plate 23 of the processing chamber 2 is made of a metal material, the microwaves are reflected and scattered into the microwave radiation space S.

<Temperature Measurement Unit>

The microwave heating apparatus 1 still further includes a plurality of radiation thermometers 26 for measuring a surface temperature of the wafer W; and a temperature measurement unit 27 connected to the radiation thermometers 26. In FIG. 1, only the radiation thermometer for measuring a surface temperature of the central portion of the wafer W is illustrated and the other radiation thermometers 26 are not shown. The radiation thermometers 26 are extended from the bottom portion 13 toward a location where the wafer W will be disposed in such a way that the upper portions of the radiation thermometers 26 approach the bottom surface of the wafer W.

<Microwave Introducing Unit>

Figure 2:
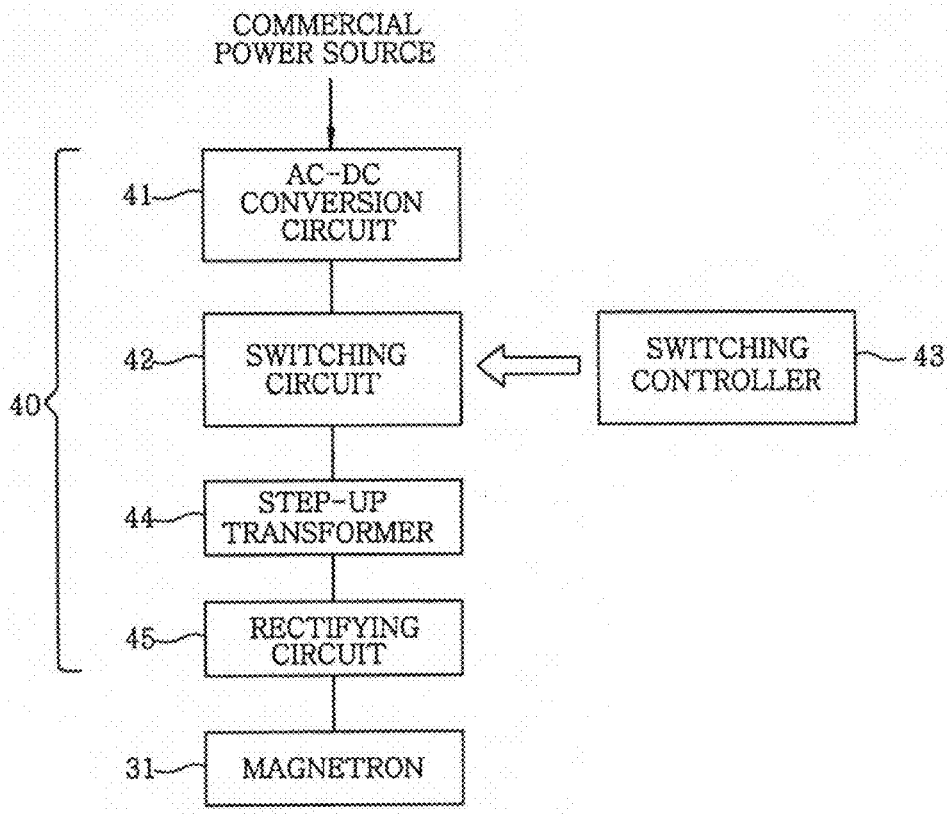
FIG. 2 explains a schematic configuration of a high voltage power supply unit of a microwave introducing unit in the embodiment of the present invention.

Next, the configuration of the microwave introducing unit 3 will be described with reference to FIGS. 1 and 2. FIG. 2 explains a schematic configuration of a high voltage power supply unit 40 of the microwave introducing unit 3.

As described above, the microwave introducing unit 3 is provided above the processing chamber 2 to introduce electromagnetic waves (microwaves) into the processing chamber 2. As shown in FIG. 1, the microwave introducing unit 3 includes a plurality of microwave units 30 for introducing microwaves into the processing chamber 2; and the high voltage power supply unit 40 connected to the microwave units 30.

(Microwave Unit)

In the present embodiment, the microwave units 30 have the same configuration. Each of the microwave units 30 includes a magnetron 31 for generating microwaves for processing the wafer W; a waveguide 32 through which the microwaves generated by the magnetron 31 are transmitted to the processing chamber 2; and a transmitting window 33 that is fixed to the ceiling portion 11 so as to cover the microwave introduction ports 10. The magnetron 31 corresponds to a microwave source in the present invention.

The magnetron 31 has an anode and a cathode (both not shown) to which a high voltage supplied by the high voltage power supply unit 40 is applied. As for the magnetron 31, a device capable of oscillating microwaves of various frequencies may be used. The frequency of the microwaves generated by the magnetron 31 is adjusted to an optimal level in accordance with process types for a target object. For example, in an annealing process, the microwaves preferably have a high frequency of about 2.45 GHz, 5.8 GHz or the like. Especially, a frequency of about 5.8 GHz is more preferably used.

The waveguide 32 is of a tubular shape having a rectangular cross section and extends upward from the top surface of the ceiling portion 11 of the processing chamber 2. The magnetron 31 is connected to a substantially upper end portion of the waveguide 32. A lower end portion of the waveguide 32 comes into contact with a top surface of the transmitting window 33. The microwaves generated by the magnetron 31 are introduced into the processing chamber 2 through the waveguide 32 and the transmitting window 33.

The transmitting window 33 is made of a dielectric material, e.g., quartz, ceramic or the like. The space between the transmitting window 33 and the ceiling portion 11 is airtightly sealed by a sealing member (not shown). A distance (gap G) from a bottom surface of the transmitting window 33 to a height level corresponding to the surface of the wafer W supported by the supporting pins 14 is preferably to set to, e.g., about 25 mm or more and more preferably set in a range from about 25 mm to 50 mm, in order to prevent the microwaves from being directly radiated onto the wafer W.

The microwave unit 30 further includes a circulator 34, a detector 35 and a tuner 36 which are provided on the waveguide 32; and a dummy load 37 connected to the circulator 34. The circulator 34, the detector 35 and the tuner 36 are provided in that order from the upper end portion of the waveguide 32. The circulator 34 and the dummy load 37 serve as an isolator for isolating reflected waves from the processing chamber 2. In other words, the circulator 34 transmits the reflected waves from the processing chamber 2 to the dummy load 37, and the dummy load 37 converts the reflected waves transmitted by the circulator 34 into heat.

The detector 35 serves to detect the reflected waves from the processing chamber 2 in the waveguide 32. The detector 35 includes, e.g., an impedance monitor, specifically a standing wave monitor for detecting an electric field in the waveguide 32. The standing wave monitor may be formed of, e.g., three pins protruding into the inner space of the waveguide 32. The reflected waves from the processing chamber 2 can be detected by detecting a location, a phase and an intensity of an electric field of standing waves by the standing wave monitor. Further, the detector 35 may be formed of a directional coupler capable of detecting traveling waves and reflected waves.

The tuner 36 serves to adjust an impedance between the magnetron 31 and the processing chamber 2. The impedance matching by the tuner 36 is performed based on the detection result of the reflected waves by the detector 35. The tuner 36 may be formed of, e.g., a conductor plate (not shown) capable of projecting into and retracting from the inner space of the waveguide 32. In that case, by adjusting the projecting amount of the conductor plate into the inner space of the waveguide 32, it is possible to control the power amount of the reflected waves at the conductor plate to thereby adjust the impedance between the magnetron 31 and the processing chamber 2.

(High Voltage Power Supply Unit)

The high voltage power supply unit 40 supplies a high voltage for generating microwaves to the magnetron 31. As shown in FIG. 2, the high voltage power supply unit 40 includes an AC-DC conversion circuit 41 connected to a commercial power source; a switching circuit 42 connected to the AC-DC conversion circuit 41; a switching controller 43 for controlling an operation of the switching circuit 42; a step-up transformer 44 connected to the switching circuit 42; and a rectifier circuit 45 connected to the step-up transformer 44. The magnetron 31 is connected to the step-up transformer 44 via the rectifier circuit 45.

The AC-DC conversion circuit 41 serves to convert alternating currents (AC) (e.g., three-phase 200V) from the commercial power source into direct currents (DC) of a predetermined waveform by rectification. The switching circuit 42 controls on and off of the DC converted by the AC-DC conversion circuit 41. In the switching circuit 42, phase-shift type PWM (Pulse Width Modulation) control or PAM (Pulse Amplitude Modulation) control is performed by the switching controller 23 to generate a pulse-shaped voltage waveform. The step-up transformer 44 serves to boost the voltage waveform outputted from the switching circuit to a predetermined level. The rectifier circuit 45 serves to rectify the voltage boosted by the step-up transformer 44 and supply the rectified voltage to the magnetron 31.

<Arrangement of Microwave Introduction Ports>

Figure 3:
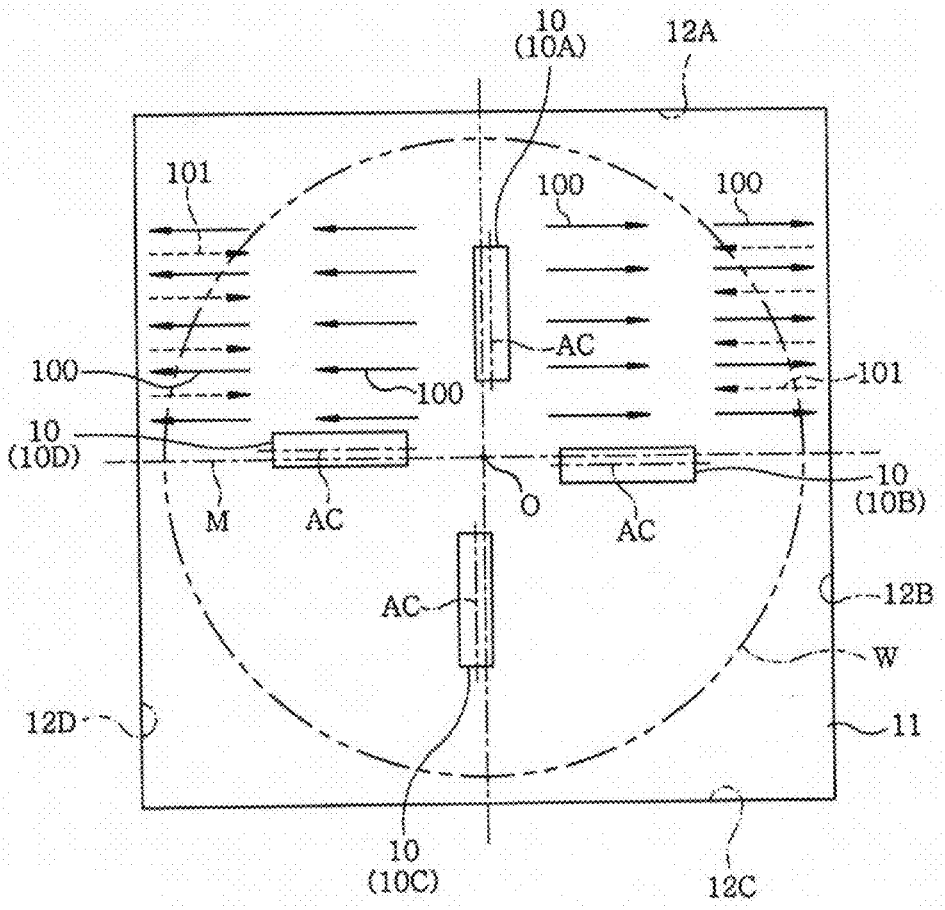
FIG. 3 is a plan view showing a bottom surface of a ceiling portion of a processing chamber shown in FIG. 1.
Figure 4:
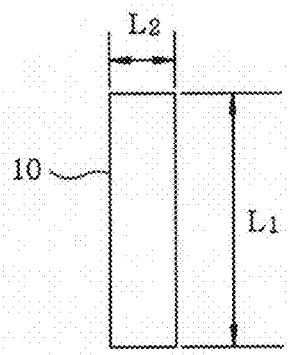
FIG. 4 is an enlarged view of a microwave introduction port.

Next, the arrangement of the microwave introduction ports 10 of the present embodiment will be described in detail with reference to FIGS. 1, 3 and 4. FIG. 3 shows a state in which the bottom surface of the ceiling portion 11 of the processing chamber 2 shown in FIG. 1 is seen from the inside of the processing chamber 2. In FIG. 3, the size and the position of the wafer W are indicated by a double dotted line on the ceiling portion 11. A notation "O" indicates the center of the wafer W. In the present embodiment, the notation O also indicates the center of the ceiling portion 11. Accordingly, two lines passing through the notation O indicate central lines M connecting central points of facing sides among four sides forming boundaries between the ceiling portion 11 and the sidewall portions 12.

Further, the center of the wafer W and the center of the ceiling portion 11 need not coincide with each other. In FIG. 3, for the convenience of explanation, reference numerals 12A to 12D are used to indicate contact portions between the ceiling portion 11 and the inner surfaces of the four sidewall portions 12 of the processing chamber 2 to distinguish the four sidewalls 12. FIG. 4 is an enlarged plan view showing one microwave introduction port 10.

As shown in FIG. 3, in the present embodiment, four microwave introduction ports 10 are equidistantly arranged in a substantially cross shape in the ceiling portion 11. Hereinafter, when the four microwave introduction ports 10 need to be distinguished, reference numerals 10A to 10D will be assigned thereto. In the present embodiment, the microwave introduction ports 10 are respectively connected to the microwave units 30. In other words, the four microwave units 30 are provided.

The microwave introduction ports 10 are of a rectangular shape having long sides and short side when viewed from the plane. A ratio $L_1/L_2$ of the long side $L_1$ to the short side $L_2$ of the microwave introduction ports 10 is set to be greater than or equal to about 2 and smaller than or equal to about 100. It is preferably set to about 4 or above and more preferably set in a range from about 5 to 20. The reason that the ratio $L_1/L_2$ is set to about 2 or above and more preferably about 4 or above is to improve the directivity of the microwaves radiated into the processing chamber 2 from the microwave introduction ports 10 in the direction perpendicular to the long side of the microwave introduction ports 10 (direction parallel to the short side).

When the ratio $L_1/L_2$ is smaller than about 2, the microwaves radiated from the microwave introduction ports 10 into the processing chamber 2 are easily directed toward the direction parallel to the long side of the microwave introduction ports 10 (direction perpendicular to the short side). Further, when the ratio $L_1/L_2$ is smaller than about 2, the directivity of the microwaves immediately below the microwave introduction ports 10 is enhanced. Accordingly, the microwaves are directly radiated to the wafer W, so that the wafer W is locally heated.

On the other hand, when the ratio $L_1/L_2$ is greater than about 20, the directivity of the microwaves immediately below the microwave introduction ports 10 or the microwaves directed toward the direction parallel to the long side of the microwave introduction ports 10 (direction perpendicular to the short side) is excessively decreased, so that the heating efficiency of the wafer W may deteriorate.

Preferably, the long side $L_1$ of the microwave introduction ports 10 satisfies the equation $L_1=n\times\lambda g/2$ (here, n indicates an integer), wherein $\lambda g$ indicates a guide wavelength of the waveguide 32. More preferably, n is set to 2. The microwave introduction ports 10 may have different sizes or ratios $L_1/L_2$. However, it is preferable that the four microwave introduction ports 10 have the same size and shape in order to improve the uniformity and the controllability of the heating process for the wafer W.

In the present embodiment, the four microwave introduction ports 10 are arranged immediately above the wafer W to vertically overlap the wafer W. Here, in order to obtain uniform distribution of the electric field on the wafer W, it is preferable that the microwave introduction ports 10 are arranged in the ceiling portion 11 in a diametrical direction of the wafer W to vertically overlap the wafer W within a distance ranging from about ⅕ to ⅗ of the radius of the wafer W in a diametrical direction from the center of the wafer W. If the uniform heating can be realized in the surface of the wafer W, the position of the wafer W may not be overlapped with the positions of the microwave introduction ports 10.

In the present embodiment, the four microwave introduction ports 10 are arranged in such a way that the long sides and the short sides thereof are in parallel with the inner surfaces of the corresponding four sidewall portions 12A to 12D. For example, in FIG. 3, the long sides of the microwave introduction ports 10A are in parallel to the sidewall portions 12B and 12D, and the short sides of the microwave introduction ports 10A are in parallel with the sidewall portions 12A to 12C. In FIG. 3, electromagnetic vectors 100 showing the dominant directivity of the microwaves radiated from the microwave introduction ports 10A are indicated by solid-line arrows, and electromagnetic vectors 101 showing the directivity of the microwaves reflected by the sidewall portions 12B and 12D are indicated by dotted-line arrows. Most of the microwaves radiated from the microwave introduction ports 10A propagate in a direction perpendicular to the long sides thereof (direction parallel to the short sides).

Moreover, the microwaves radiated from the microwave introduction ports 10A are reflected by the two sidewall portions 12B and 12D. Since the sidewall portions 12B and 12D are disposed in parallel to the long sides of the microwave introduction ports 10A, the reflected waves (the electromagnetic vectors 101) have directivity reversed by about 180° from the directivity of the traveling waves (the electromagnetic vectors 100) and are hardly scattered toward the other microwave introduction ports 10B to 10D. By arranging the four microwave introduction ports 10 having the ratio $L_1/L_2$ of about 2 or above in such a way that the long sides and the short sides thereof are in parallel with the inner surfaces of the four sidewall portions 12A to 12D, it is possible to control the directions of the microwaves radiated from the microwave introduction ports 10 and the reflected waves thereof.

In the present embodiment, the four microwave introduction ports 10 having the ratio $L_1/L_2$ of, e.g., about to above, are circumferentially arranged at positions spaced apart from each other at an angle of about 90°. In other words, the four microwave introduction ports 10 are rotationally symmetrically arranged about the center O of the ceiling portion 11, and the rotation angle is about 90°. Further, the microwave introduction ports 10 are arranged in such a way that each one of the microwave introduction ports is not overlapped with another microwave introduction port 10 whose long sides are in parallel with the long sides of the corresponding microwave introduction port 10 when the corresponding microwave introduction port 10 is moved in translation in a direction perpendicular to the long sides thereof.

In FIG. 3, the microwave introduction ports 10A to 10D are arranged in a cross shape, for example. In other words, two adjacent microwave introduction ports 10 are spaced apart from each other at an angel of about 90° such that the central axes AC thereof parallel to the long sides of the adjacent microwave introduction ports 10 are perpendicular to each other. Moreover, even when the microwave introduction port 10A is moved in translation in a direction perpendicular to the long side thereof, the microwave introduction ports 10A is not overlapped with the microwave introduction port 100 whose long side is in parallel to the long side of the microwave introduction port 10A. In other words, the microwave introduction port 10 (the microwave introduction port 100) having the same longitudinal direction as that of the microwave introduction port 10A are not disposed between the two sidewall portions 12B and 12D parallel to the long side of the microwave introduction port 10A within the length of the long side of the microwave introduction port 10A.

With such arrangement, it is possible to efficiently prevent the microwaves radiated from the microwave introduction port 10A with the directivity perpendicular to the long side of the microwave introduction port 10A and the reflected waves thereof from entering other microwave introduction ports 10. In other words, if other microwave introduction ports 10 having the same direction are interposed between the two sidewall portions 12B and 12D parallel to the microwave introduction port 10A within the length of the long side of the microwave introduction port 10A, the microwaves are excited in the same direction. Therefore, the microwaves and the reflected waves easily enter the microwave introduction ports 10 of the same direction, and this leads to an increase of power loss. On the other hand, if no microwave introduction port 10 having the same direction as that of the microwave introduction port 10A is interposed between the two parallel sidewall portions 12B and 12D within the length of the long side of the microwave introduction port 10A, it is possible to reduce the power loss caused when the microwaves radiated from the microwave introduction port 10A and the reflected waves thereof enter other microwave introduction ports 10.

In FIG. 3, the microwaves radiated from the microwave introduction ports 10A and the reflected waves thereof hardly enter the microwave introduction ports 10B and 10D because they are excited in a different direction from those radiated from the microwave introduction ports 10B and 10D that are arranged adjacent to the microwave introduction port 10A by an interval of about 90°. Therefore, when the microwave introduction port 10A is moved in translation in a direction perpendicular to the long side thereof, it may be overlapped with the microwave introduction ports 10B and 10D having different longitudinal directions.

In the present embodiment, two microwave introduction ports 10 that are not adjacent to each other among the four microwave introduction ports 10 forming a cross shape are arranged such that the central axes AC thereof are not overlapped with each other on the same straight line. For example, in FIG. 3, the microwave introduction port 10A and the microwave introduction port 10C that is not adjacent thereto are arranged so as not to be overlapped with each other although the central axes thereof are disposed in the same direction. As such, by arranging two microwave introduction ports 10 that are not adjacent to each other among the four microwave introduction ports 10 forming a cross shape in such a way that the central axes AC thereof are not overlapped with each other on the same straight line, it is possible to reduce power loss caused when the microwaves radiated in a direction perpendicular to the short sides thereof from one of the two microwave introduction ports 10 having the same direction of the central axes AC enter the other microwave introduction port.

In such arrangement, the central axis AC of each of the microwave introduction ports 10 need not coincide with the central line M. Therefore, the microwave introduction ports 10 may be located at positions significantly deviated from the central line M. For example, the long sides of the microwave introduction ports 10 may be disposed at positions adjacent to the sidewall portions 12. However, it is preferable that the microwave introduction ports 10 are disposed near the central line M in order to uniformly introduce the microwaves into the processing chamber 2. As shown in FIG. 3, it is preferable that at least some of the microwave introduction ports 10 coincides with the central line M. In another embodiment, two microwave introduction ports 10 that are not adjacent to each other among the four microwave introduction ports 10 forming a cross shape may be arranged such that the central axes AC thereof coincide with each other. In that case, the central axes AC may coincide with the central line M.

Although the microwave introduction port 10A has been described as an example, the other microwave introduction ports 10B to 10D are also arranged such that the above-described relationship is satisfied between the corresponding microwave introduction ports 10 and the corresponding sidewall portions 12.

<Control Unit>

Figure 5:
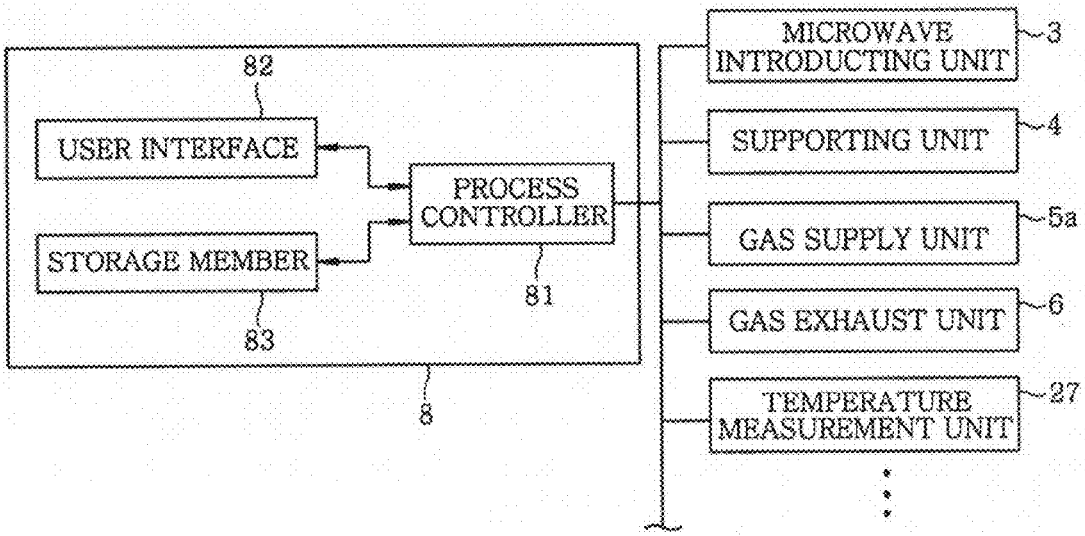
FIG. 5 shows a configuration of a control unit shown in FIG. 1.

Various components of the microwave heating apparatus 1 are connected to the control unit 8 and controlled by the control unit 8. The control unit 8 is typically a computer. FIG. 5 explains a configuration of the control unit 8 shown in FIG. 1. In the example shown in FIG. 5, the control unit 8 includes a process controller 81 having a CPU; and a user interface 82 and a storage unit 83 which are connected to the process controller 81.

The process controller 81 serves to control the components (e.g., the microwave introducing unit 3, the supporting unit 4, the gas supply unit 5*a*, the gas exhaust unit 6, the temperature measurement unit 27 and the like) of the microwave heating apparatus 1 which are related to the processing conditions such as a temperature, a pressure, a gas flow rate, a microwave output and the like.

The user interface 82 includes a keyboard or a touch panel on which a process operator inputs commands to operate the microwave heating apparatus 1; a display for visually displaying the operation status of the microwave heating apparatus 1 and the like.

The storage unit 83 stores therein control programs (software) or recipes including processing condition data to be used in realizing various processes that are performed by the microwave heating apparatus 1 under the control of the process controller 51. If necessary, the process controller 81 retrieves a control program or recipe from the storage unit 83 in accordance with an instruction from the user interface 82 and executes the control program or recipe. As a consequence, a desired process in the processing chamber 2 of the microwave heating apparatus 1 is performed under the control of the process controller 81.

The control programs or the recipes may be stored in a computer-readable storage medium, e.g., a CD-ROM, a hard disk, a flexible disk, a flash memory, a DVD, a Blu-ray disc or the like. Further, the recipes may be transmitted on-line from another device through, e.g., a dedicated line, when necessary.

[Processing Sequence]

Hereinafter, a processing sequence for annealing a wafer W in the microwave heating apparatus 1 will be described. First, a command for performing annealing in the microwave heating apparatus 1 is inputted from the user interface 82 to the process controller 81. Second, the process controller 81 receives the command and reads out the recipes that have been stored in the storage unit 83 or the computer-readable storage medium. Then, control signals are transmitted from the process controller 81 to the end devices (e.g., the microwave introducing unit 3, the supporting unit 4, the gas supply unit 5*a*, the gas exhaust unit 6 and the like) of the microwave heating apparatus 1 such that the annealing process is performed under the conditions based on the recipes.

Thereafter, the gate valve GV is opened, and the wafer W is loaded into the processing chamber 2 through the gate valve GV and the loading/unloading port 12*a* by a transfer unit (not shown). The wafer W is mounted on the supporting pins 14. Then, the gate valve GV is closed, and the processing chamber 2 is vacuum-evacuated by the gas exhaust unit 6. At this time, the opening/closing valve 20 is opened, so that the bottom surface of the wafer W is sucked and the wafer W is fixed by suction to the supporting pins 14. Next, a processing gas and a cooling gas of predetermined flow rates are introduced into the processing chamber 2 by the gas supply unit 5*a*. The inner space of the processing chamber 2 is controlled to a predetermined pressure by adjusting a gas exhaust amount and a gas supply amount.

Thereafter, microwaves are generated by applying a voltage from the high voltage power supply unit 40 to the magnetron 31. The microwaves generated by the magnetron 31 transmit the waveguide 32 and the transmitting window 33 and then are introduced into a space above the wafer W in the processing chamber 2. In the present embodiment, microwaves are sequentially generated by the magnetrons 31 and introduced into the processing chamber 2 through the microwave introduction ports 10. The magnetrons may be simultaneously generated by the magnetrons 31 and introduced into the processing chamber 2 from the microwave introduction ports 10.

The microwaves introduced into the processing chamber 2 are radiated to the surface of the wafer W, so that the wafer W is rapidly heated by electromagnetic wave heat such as Joule heat, magnetic heat, induction heat or the like. As a result, the wafer W is annealed When a control signal for completing the annealing process is transmitted from the process controller 81 to the end devices of the microwave heating apparatus 1, the generation of the microwaves is stopped and the supply of the processing gas and the cooling gas is stopped. In this manner, the annealing for the wafer W is completed. Next, the gate valve is opened, and the wafer W is unloaded by a transfer unit (not shown).

The microwave heating apparatus 1 is preferably used for an annealing process for activating doping atoms injected into the diffusion layer in the manufacturing process of semiconductor devices, for example.

Hereinafter, the functional effects of the microwave heating apparatus 1 and the method for processing a wafer W by using the microwave heating apparatus 1 in accordance with the embodiment of the present invention will be described with reference to FIGS. 3, 6A, 6B, 7A and 7B. In the present embodiment, with the combination of the shape and arrangement of the microwave introduction ports 10 and the shapes of the sidewall portions 12 of the processing chamber 2, the microwaves radiated from the microwave introduction ports 10 into the processing chamber 2 are efficiently radiated to the wafer W while the microwaves radiated from one of the microwave introduction ports 10 is suppressed from entering the other microwave introduction ports 10. This principal will be described below.

Figure 6A:
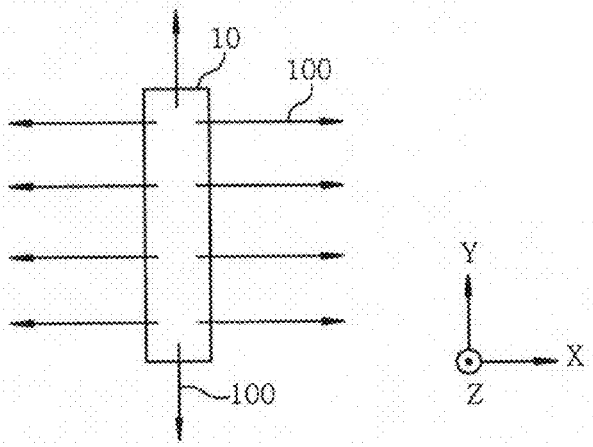
FIGS. 6A to 6B are an explanatory view schematically showing electromagnetic vectors of microwaves radiated from a microwave introduction port.
Figure 6B:
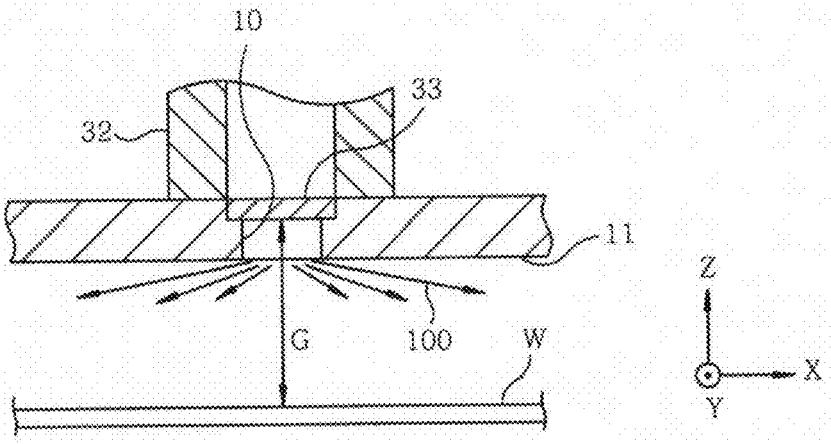
Figure 7A:
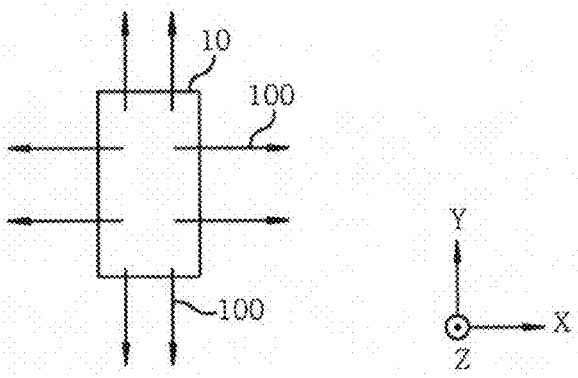
FIGS. 7A and 7B are another explanatory views schematically showing electromagnetic vectors of microwaves radiated from a microwave introduction port.
Figure 7B:
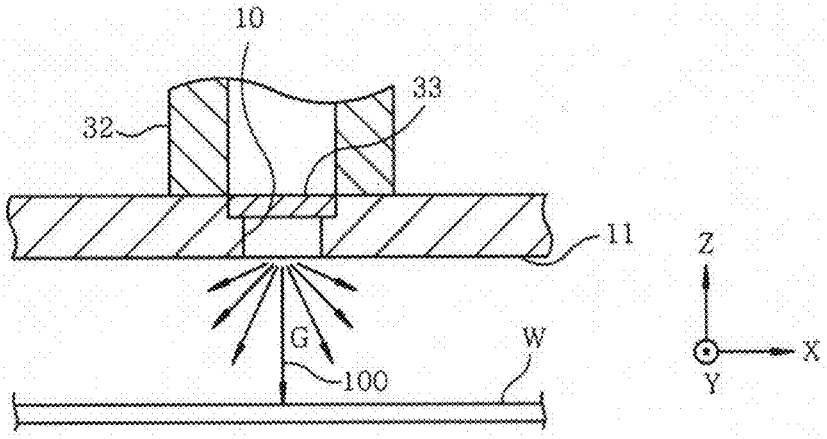

FIGS. 6A and 6B schematically show the radiation directivity of the microwaves in the microwave introduction port 10 in which the ratio $L_1/L_2$ between the lengths of the long side $L_1$ and the short side $L_2$ is about 4 or above. FIGS. 7A and 7B schematically show the radiation directivity of the microwaves in the microwave introduction port 10 having the ratio $L_1/L_2$ smaller than about 2. FIGS. 6A and 7A show the microwave introduction port 10 viewed from a lower portion of the ceiling portion 11 that is not shown therein. FIGS. 6B and 7B are partial enlarged cross sectional views of FIG. 1 to show cross sections of the microwave introduction port 10 and the ceiling portion 11.

In FIGS. 6A, 6B, 7A and 7B, arrows indicate the electromagnetic vectors 100 radiated from the microwave introduction port 10. Longer arrows indicate stronger directivity of the microwaves. In FIGS. 6A, 6B, 7A and 7B, the X-axis and the Y-axis are in parallel to the bottom surface of the ceiling portion 11; the X-axis is perpendicular to the long sides of the microwave introduction ports 10; the Y-axis is in parallel to the long sides of the microwave introduction ports 10; and the Z-axis is perpendicular to the bottom surface of the ceiling portion 11.

In the present embodiment, as described above, the four microwave introduction ports 10 formed in a rectangular shape having long sides and short sides when seen from above are arranged at the ceiling portion 11. Further, the microwave introduction ports 10 used in the present embodiment preferably have the ratio $L_1/L_2$ of, e.g., about 2 or above, and more preferably about 4 or above. Thus, as shown in FIG. 6A, the radiation directivity of the microwaves is increased and dominant in a direction perpendicular to the long side (direction parallel to the short side) along the X-axis. Accordingly, the microwaves radiated from any of the microwave introduction ports 10 mainly propagate along the ceiling portion 11 of the processing chamber 2 and then are reflected by the reflective surfaces, i.e., the inner surfaces of the sidewall portions 12 parallel to the long sides thereof.

In the present embodiment, the four sidewall portions 12 of the processing chamber 2 are orthogonally connected to one another, and the four microwave introduction ports 10 are disposed in such a way that the long sides and the short sides thereof are in parallel to the inner surfaces of the four sidewall portions 12A to 12D. Therefore, the reflected waves of the microwaves radiated from one of the microwave introduction ports 10 are directed substantially in a 180° reversed direction and thus hardly enter the other microwave introduction ports 10.

In the present embodiment, as shown in FIG. 3, the four microwave introduction ports 10 having the ratio $L_1/L_2$ of, e.g., about 2 or above, are arranged at locations spaced apart from each other at an angle of about 90°. In other words, the four microwave introduction ports 10 are arranged at an interval of about 90° such that they substantially form an a cross shape and the central axes AC thereof parallel to the long sides of the two adjacent microwave introduction ports 10 are perpendicular to each other.

Further, the microwave introduction ports 10 are arranged in such a way that each one of the microwave introduction ports 10 is not overlapped with another microwave introduction port 10 whose long sides are in parallel to the long sides of the corresponding microwave introduction port 10 when the corresponding microwave introduction port 10 is moved in translation in a direction perpendicular to the long sides thereof. Hence, it is possible to prevent the microwaves radiated from one of the microwave introduction ports 10 having the same excitation direction of the microwaves and the reflected waves thereof from entering the other microwave introduction port 10 in a direction perpendicular to the long sides of the microwave introduction port 10.

Furthermore, by arranging the two microwave introduction ports 10 that are not adjacent to each other among the four microwave introduction ports 10 are arranged such that the central axes AC thereof are not overlapped with each other on the same straight line, the microwaves radiated from one of the microwave introduction ports 10 having the same excitation direction of the microwaves and the reflected waves thereof hardly enter the other microwave introduction port 10 in a direction perpendicular to the short sides of the microwave introduction port 10.

As such, in the present embodiment, the microwave introduction ports 10 are arranged in consideration of the shape of the microwave introduction ports 10, especially the ratio $L_1/L_2$, the radiation directivity of the microwaves which depends on the shape of the microwave introduction ports 10, and the shape of the sidewall portions 12. Therefore, it is possible to prevent the microwaves introduced from one of the microwave introduction ports 10 from entering the other microwave introduction ports 10, thereby minimizing the power loss.

In the microwave heating apparatus 1 of the present embodiment, by employing the combination of the shape and arrangement of the microwave introduction ports 10 and the shape of the sidewall portions 12, it is possible to prevent the microwaves having the radiation directivity shown in FIGS. 6A and 6B radiated from one of the microwave introduction ports 10 and/or the reflected waves propagating in the reverse direction thereof from entering the other microwave introduction port 10 to thereby improve the use efficiency of supplied power.

In the present embodiment, by setting the ratio $L_1/L_2$ to about 2 or above and preferably about 4 or above, as shown in FIG. 6B, the directivity of the microwaves radiated from the microwave introduction ports 10 is increased in the horizontal direction (X-axis direction) and widened mainly in the horizontal direction along the bottom surface of the ceiling portion 11. Further, in the present embodiment, the distance (gap G) from the bottom surface of the transmitting window 33 to the surface of the wafer W supported by the supporting pins 14 is set to about 25 mm or above. As such, by ensuring the sufficient gap G in consideration of the radiation directivity of the microwaves, few microwaves are directly radiated to the wafer W positioned immediately below the microwave introduction ports 10 and, thus, the heating is uniformly carried out. As a result, in the microwave heating apparatus 1 of the present embodiment, the wafer W can be uniformly processed.

Meanwhile, in the case of the microwave introduction ports 10 having the ratio $L_1/L_2$ smaller than 2, as shown in FIG. 7A, the directivity of the microwaves is increased in a direction parallel to the long sides (direction perpendicular to the short sides) along the Y-axis. Hence, the directivity thereof is relatively decreased in a direction perpendicular to the long sides (direction parallel to the short sides), and thus the difference in the radiation directivities of the microwaves is eliminated. Accordingly, when the microwave introduction ports 10 having the ratio $L_1/L_2$ smaller than 2 (e.g., long side:short side=1:1) are arranged as shown in FIG. 3, the microwaves radiated from the microwave introduction port 10A propagate in a direction parallel to the long sides of the microwave introduction ports 10A. Then, the microwave may enter the microwave introduction port 10C.

Further, the directivity of the microwaves radiated from the microwave introduction ports 10 having the ratio $L_1/L_2$ smaller than 2 is increased in a downward direction (i.e., in a direction toward the wafer W along the Z-axis) as shown in FIG. 7B, so that the ratio in which the microwaves are directly radiated to the wafer W immediately below the microwave introduction ports 10 is increased. As a consequence, the wafer W is locally heated.

Figure 8A:
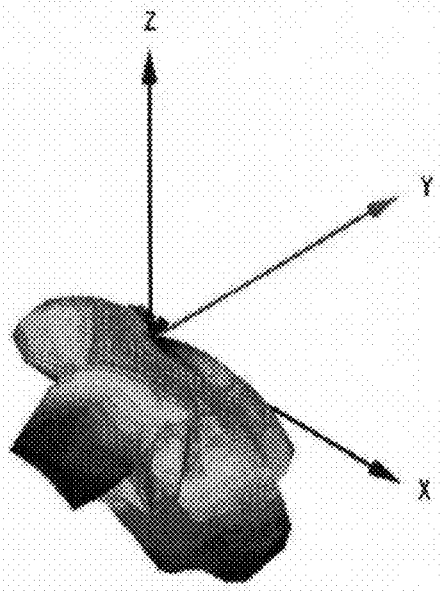
FIG. 8A shows a simulation result of a microwave radiation directivity in the case of using a microwave introduction port having a ratio between a long side and a short side which is about 6.
Figure 8B:
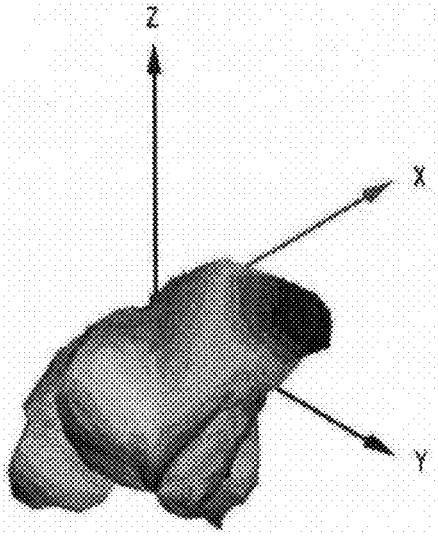
FIG. 8B shows a simulation result of a microwave radiation directivity in the case of using a microwave introduction port having a ratio of a long side to a short side which is smaller than about 2.

Hereinafter, the result of simulation on the radiation directivity of the microwave introduction ports 10 on which the present invention is based will be explained with reference to FIGS. 8A and 8B. FIG. 8A shows the result of simulation on the radiation directivity of the microwave introduction ports 10 having the ratio $L_1/L_2$ of about 6. FIG. 8B shows the result of simulation on the radiation directivity of the microwave introduction ports 10 having the ratio $L_1/L_2$ smaller than 2. The X-axis, the Y-axis and the Z-axis in FIGS. 8A and 8B are the same as those in FIGS. 6A, 6B, 7A and 7B.

Although the radiation directivity is not explicitly expressed because it is indicated by black and white in FIGS. 8A and 8B, the darker (black) indicates the higher radiation directivity.

Referring to FIG. 8A, the microwave introduction port 10 having the ratio $L_1/L_2$ of about 6 has a higher radiation directivity in the X-axis direction and a lower radiation directivity in the Y-axis direction and the Z-axis direction. On the other hand, referring to FIG. 8B, the microwave introduction port 10 having the ratio $L_1/L_2$ smaller than about 2 has a higher radiation directivity in the Z-axis direction (in a downward direction). This indicates that the microwaves tend to be radiated from the microwave introduction ports 10 in the same moving direction as that in the waveguide 32 and then directly radiated toward the wafer W. Therefore, by setting the ratio $L_1/L_2$ to, e.g., about 2 or above, preferably about 4 or above, the radiated microwaves can be efficiently propagated in a direction perpendicular to the long sides of the microwave introduction ports 10 and in a horizontal direction along the bottom surface of the ceiling portion 11.

Next, a result of simulation on the power absorption efficiency of the wafer W in the case of varying the shape of the processing chamber and the shape and the arrangement of the microwave introduction ports 10 will be described with reference to FIGS. 9A to 9C. The upper images shown in FIGS. 9A to 9C explain the shape and arrangement of the microwave introduction ports 10 and the sidewall portions 12 of the microwave heating apparatus 1 as the simulation target which are projected with respect to the arrangement of the wafer W. The intermediate images shown therein are simulation result maps showing the volume loss density distribution of the microwave power in the surface of the wafer The lower images show a scattering parameter, a wafer absorption power ($P_w$), and a ratio ($A_w$) of a wafer area to an entire area (wafer area+inner area of the processing chamber) which can be obtained from the simulation. In this simulation, the examination was performed by introducing the microwaves of about 3000 W from one microwave introduction port indicated by the black box in the upper images of FIGS. 9A to 9C. The dielectric loss tangent (tans) of the wafer W was set to about 0.1.

Figure 9A:
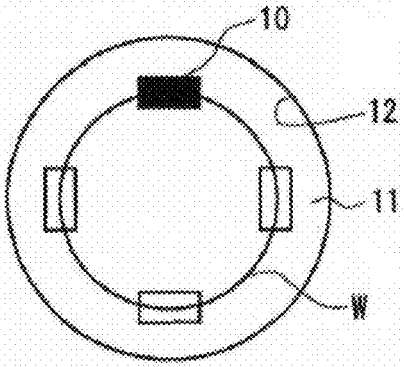
FIG. 9A shows a simulation result of a power absorption ratio of microwave introduction ports that are arranged in accordance with a comparative example.
Figure 9A:
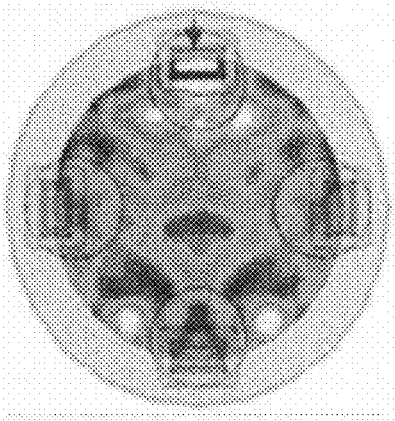

FIG. 9A shows the result simulation on a configuration of a comparative example in which four microwave introduction ports 10 are provided in a processing chamber having a cylindrical sidewall portion 12. FIG. 9B shows a result of simulation on a configuration example in which four microwave introduction ports 10 are provided at a processing chamber having a square column shaped sidewall portion 12. In FIGS. 9A and 9B, the ratio $L_1/L_2$ between the lengths of the long side $L_1$ and the short side $L_2$ of the microwave introduction ports 10 is set to about 2. Further, in FIGS. 9A and 9B, the microwave introduction ports 10 are arranged immediately above an outer peripheral portion of the circular wafer W such that the tangential direction of the peripheral portion of the wafer W is in parallel to the longitudinal direction of the microwave introduction ports 10. Moreover, in FIG. 9B, the microwave introduction ports 10 are arranged in such a way that each one of the microwave introduction ports 10 overlapped with another microwave introduction port 10 whose long sides are in parallel to the long sides of the corresponding microwave introduction port 10 when the corresponding microwave introduction port 10 is moved in translation in a direction perpendicular to the long sides thereof.

Figure 9B:
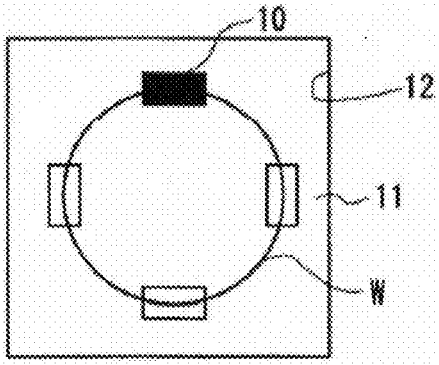
FIG. 9B shows a simulation result of a power absorption ratio of microwave introduction ports that are arranged in accordance with another comparative example.
Figure 9B:
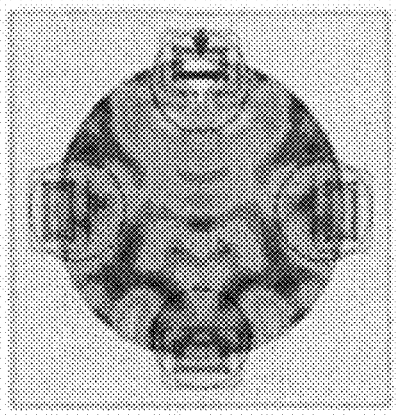
Figure 9C:
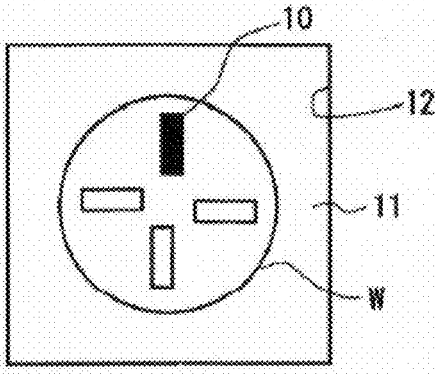
FIG. 9C shows a simulation result of a power absorption ratio of microwave introduction ports that are arranged in accordance with the present embodiment.
Figure 9C:
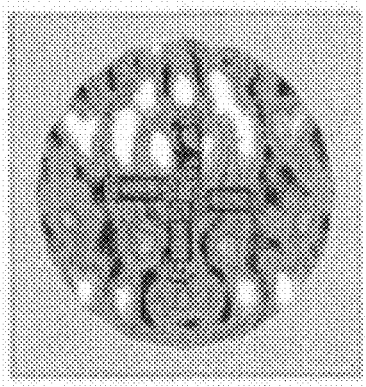

Meanwhile, FIG. 9C shows the simulation result on a configuration same as that of the present embodiment in which four microwave introduction ports 10 are disposed at rotation positions of about 90° in the processing chamber having a square column shaped sidewall portion 12. In FIG. 9C, long sides and short sides of the four microwave introduction ports 10 are in parallel with the inner surfaces of the four sidewall portions 12, and the ratio $L_1/L_2$ between the lengths of the long side $L_1$ and the short side $L_2$ of the microwave introduction ports 10 is set to about 4. Moreover, in FIG. 9C, the microwave introduction ports 10 are arranged in such a way that each one of the microwave introduction ports 10 is not overlapped with another microwave introduction port 10 whose long sides are in parallel with the long sides of the corresponding microwave introduction port 10 when the corresponding microwave introduction port 10 is moved in translation in a direction perpendicular to the long sides thereof.

Here, the absorption power of the wafer W may be calculated by using scattering parameters (S parameters). On the assumption that an input power is $P_{in}$, and an entire power absorbed by the wafer W is $P_w$, the entire power Pw may be calculated by the following Eq. 1. Notations "S11," "S21," "S31" and "S41" denote S parameters of the four microwave introduction ports 10. The microwave introduction port 10 indicated by the black shaded box corresponds to PORT 10.

$$P_w = P_{in}(1-|S11|^2-|S21|^2-|S31|^2-|S41|^2) \quad \text{Eq. 1}$$

In order to increase the power absorption efficiency of the wafer W, it is preferable to increase a ratio of an area of the wafer W to the inner area of the processing chamber which defines the microwave radiation space S and also preferable to increase "$A_w$" shown in the following Eq. 2. $A_w$ represents a ratio of the wafer area to the entire area (the wafer area+the inner area of the processing chamber).

$$A_w = [\text{wafer area}/(\text{wafer area}+\text{inner area of processing chamber})]\times 100 \quad \text{Eq. 2}$$

The distribution of the power absorption in the surface of the wafer W was obtained by calculating an electromagnetic wave volume loss density by using pointing vectors in the surface of the wafer W. Further, the entire power $P_w$ absorbed by the wafer W and the power $p_w$ absorbed by the wafer W per unit volume may be calculated by the following Eqs. 3 and 4, respectively. The maps in the intermediate images of FIGS. 9A to 9C were created by calculating such values by using an electromagnetic field simulator and plotting same on the wafer W. Although the electromagnetic wave volume loss density is not explicitly expressed because the maps are indicated by black and white, the lighter black (white) indicates the higher electromagnetic wave volume loss density in the surface of the wafer W.

$$P_w[w] = \iint_{sw} Re\vec{S}\cdot\vec{n}\,dS = \int_{sw}\int^{\delta w}\int_0 Re\left[\frac{1}{2}(\vec{E}\cdot\vec{J}*-\nabla\times\vec{E}\cdot\vec{H}*)\right] dS\,dZ \quad \text{Eq. 3}$$

where, $\vec{S}$, $\vec{J}$, $\vec{E}$ and $\vec{H}$ respectively indicate pointing vector, current density, electric field and magnetic field.

$$p_w[W/m^3] = Re\left[\frac{1}{2}(\vec{E}\cdot\vec{J}*-\nabla\times\vec{E}\cdot\vec{H}*)\right] \quad \text{Eq. 4}$$

In the case of using the wafer W as a target object to be processed, Joule loss mainly occurs in the Eqs. 3 and 4. Therefore, the relationship between the power pw absorbed by the wafer W per unit volume and the electric field may be expressed by using the following Eq. 5 modified from the Eq. 4. The power $p_w$ absorbed by the wafer W per unit volume is substantially in proportion to a square of the electric field.

$$p_w[W/m^3] = Re\left[\frac{1}{2}(\vec{E}\cdot\vec{J}*-\nabla\times\vec{E}\cdot\vec{H}*)\right] \approx \sigma|\vec{E}|^2 \propto |\vec{E}|^2 \quad \text{Eq. 5}$$

The comparison between FIGS. 9A and 9B and 9C reveals that the case shown in the FIG. 9C which employs the combination of the shape and arrangement of the microwave introduction ports 10 and the shape of the sidewall portions 12 of the processing chamber 2 in accordance with the present embodiment ensures a small difference in the electric field, an increased entire power Pw absorbed by the wafer W and an excellent power absorption efficiency. Moreover, the ratio $A_w$ of the area of the wafer W to the inner area of the processing chamber which defines the microwave radiation space S is higher in the case shown in FIG. 9C than the cases shown in FIGS. 9A and 9B.

Figure 9D:
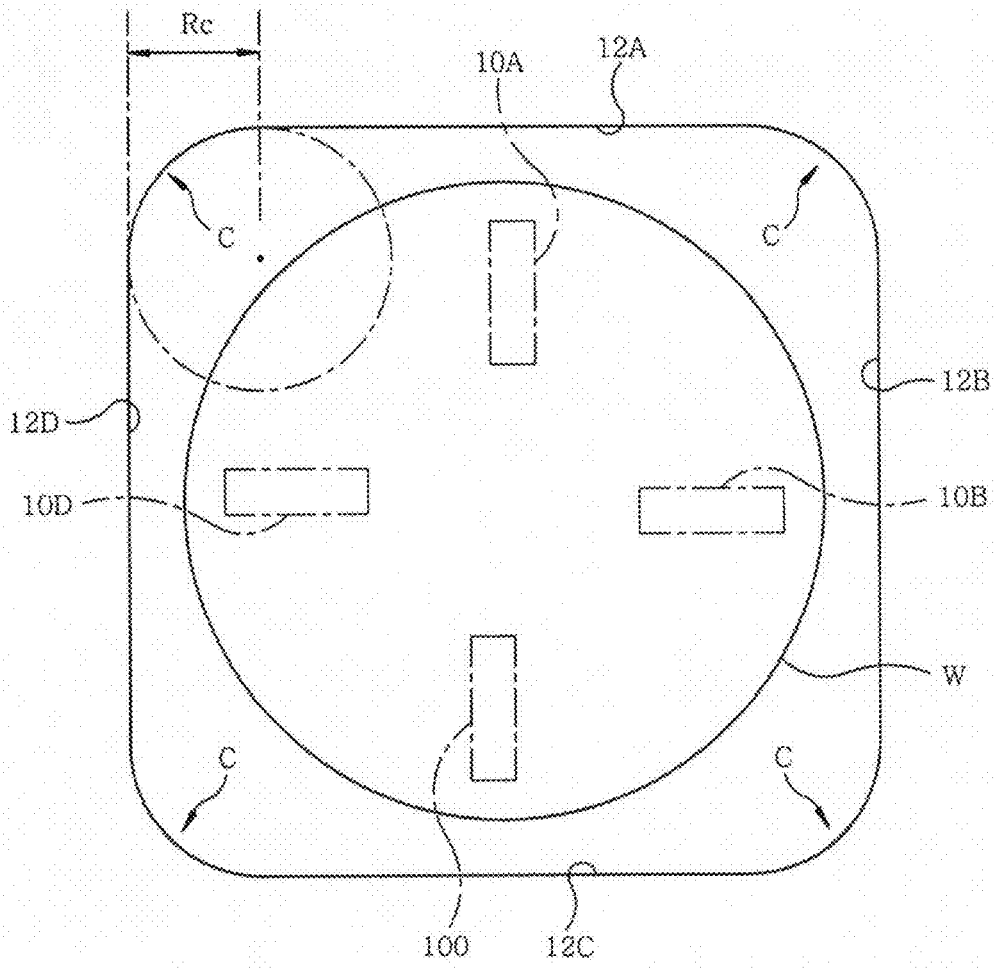
FIG. 9D schematically show a configuration of a microwave heating apparatus used for simulation on a rounding process of each portion.

Next, a simulation result on the effects of rounding of angled inner portions of connecting parts between adjacent sidewall portions 12 of the processing chamber 2 on the reflection of microwaves will be explained with reference to FIGS. 9D and 9E. FIG. 9D schematically shows a configuration of a microwave heating apparatus used in the simulation. Specifically, FIG. 9D schematically shows the shape of the sidewall portion 12 (only the position of the inner surfaces are shown) in the case of performing rounding of the connecting parts between the adjacent sidewall portions 12, and the positional relationship of the wafer W.

FIG. 9D also shows the positions of the four microwave introduction ports 10A to 10D provided in the ceiling portion 11 (not shown) which are projected above the wafer W. As can be seen from FIG. 9D, the angled inner portions C between the sidewall portions 12A and 12B, the sidewall portions 12B and 12C, the sidewall portions 12C and 12D, and the sidewall portions 12D and 12A are rounded with a curvature of radius Rc. Other configurations are the same as those of the microwave heating apparatus 1 shown in FIG. 1.

In the simulation, scattering parameters S11 and S31 were analyzed by varying the curvature of radius Rc of the rounding processing of the angled inner portions C in the unit of 1 mm in a range from 0 mm (right angle) to 18 mm. Here, the scattering parameters S11 and S31 were analyzed on the assumption that the microwaves were introduced through the microwave introduction port 10A. S11 is a scattering parameter of the microwaves radiated from the microwave introduction port 10A and the reflected waves thereof. S31 is a scattering parameter of the microwaves radiated from the microwave introduction port 10A and reflected to the microwave introduction port 10C.

Figure 9E:
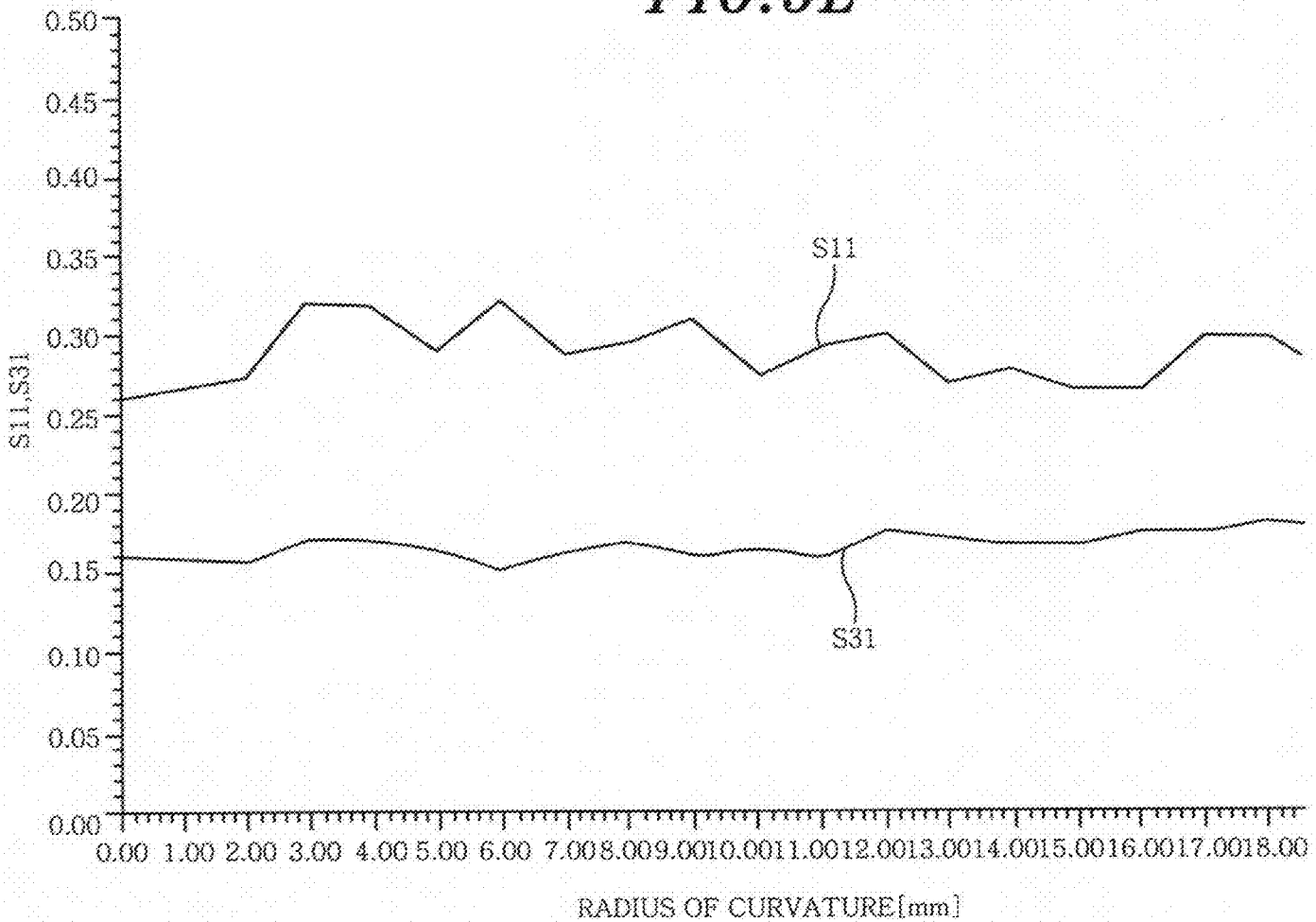
FIG. 9E shows a simulation result of the rounding process of each portion.

FIG. 9E shows the simulation result. As can be seen from FIG. 9E, when the radius of curvature Rc is within the range from about 15 mm to 16 mm, S11 and S31 have little variation and have relatively low values. Accordingly, in order to prevent the reflected waves from entering the microwave introduction ports 10 and increase the use efficiency of the microwave power, it is preferable to perform rounding of the angled inner portions C of the connecting parts between adjacent sidewall portions 12 of the processing chamber 2 by setting the curvature of radius Rc within the range from about 15 mm to 16 mm. Although this simulation has been performed on the rounding of the angled inner portions C of the connecting parts between adjacent sidewall portions 12 of the processing chamber 2, the curvature of radius Rc may be preferably applied to the rounding of the angled inner portions of the connecting parts between the sidewall portions 12 and the bottom portion 13.

As can be seen from the above simulation results, the microwave heating apparatus 1 of the present embodiment provides excellent power use efficiency and heating efficiency by reducing the loss of the microwaves radiated into the processing chamber 2. Besides, it is found that the wafer W can be uniformly heated by using the microwave heating apparatus 1 of the present embodiment.

Second Embodiment

Figure 10:
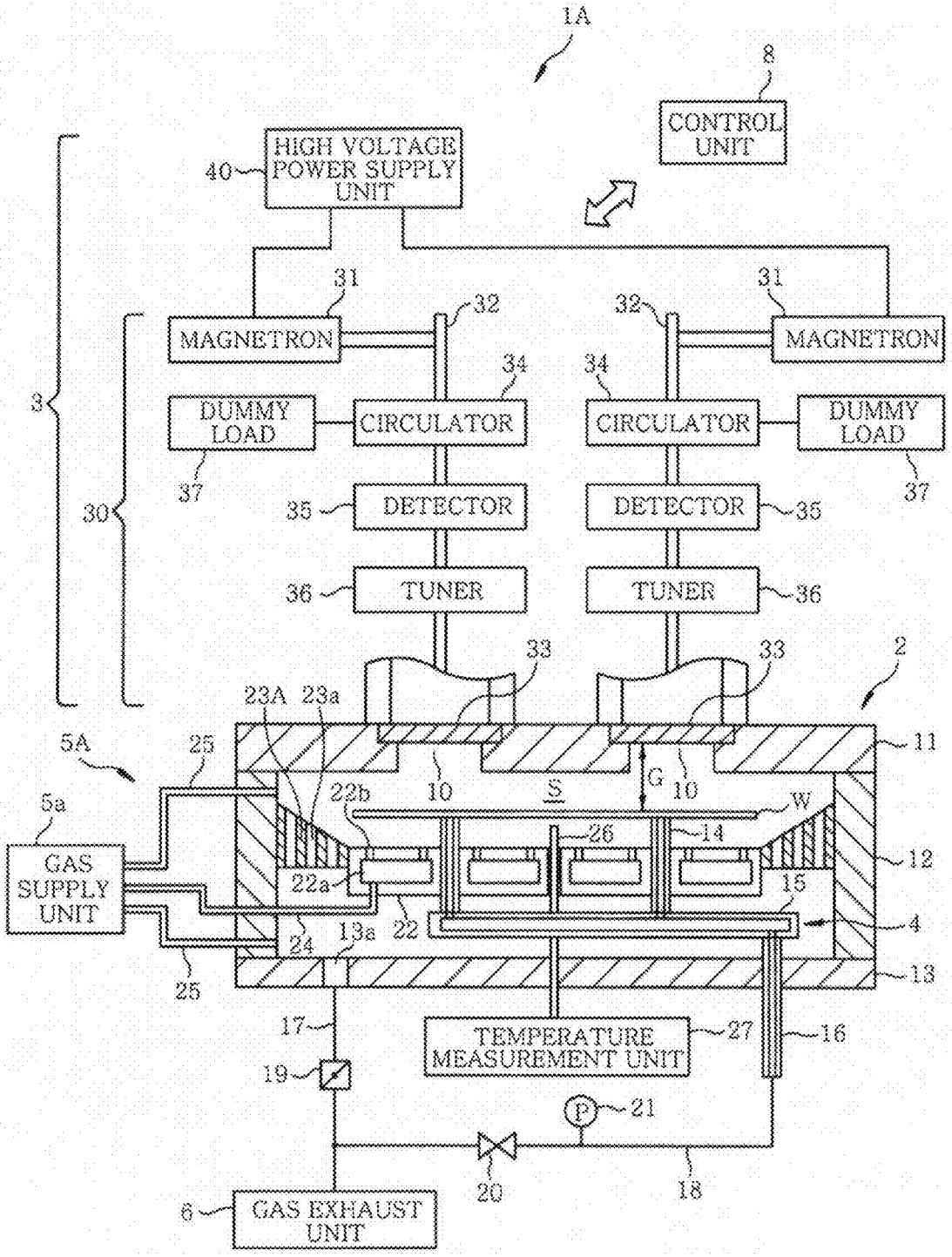
FIG. 10 is a cross sectional view showing a schematic configuration of a microwave heating apparatus in accordance with a second embodiment of the present invention.
Figure 11:
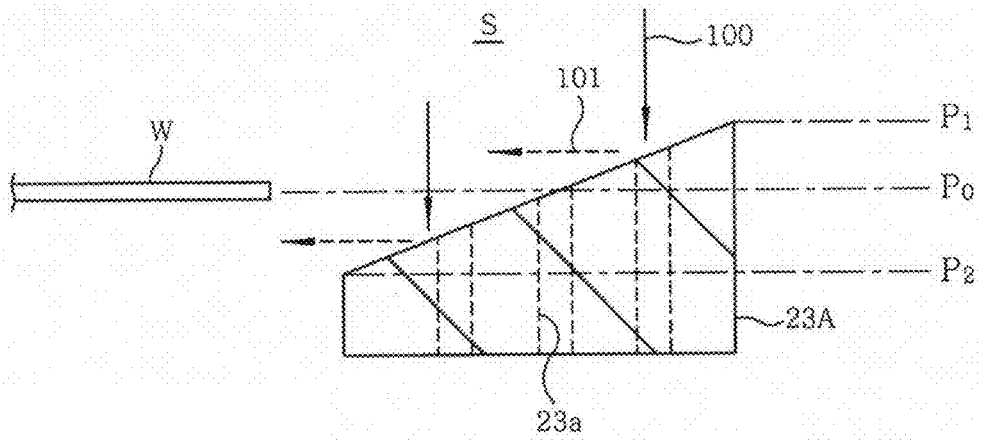
FIG. 11 schematically show electromagnetic vectors of microwaves reflected by an inclined portion in the second embodiment of the present invention.

Next, a microwave heating apparatus in accordance with a second embodiment of the present invention will be described with reference to FIGS. 10 and 11. FIG. 10 is a cross sectional view showing a schematic configuration of a microwave heating apparatus 1A of the present embodiment. FIG. 11 explains a rectifying plate 23A of the microwave heating apparatus 1A of the present embodiment which serves as a microwave reflection mechanism.

The microwave heating apparatus 1A of the present embodiment includes a processing chamber 2 for accommodating a wafer W as a target object to be processed; a microwave introducing unit 3 for introducing microwaves into the processing chamber 2; a supporting unit 4 for supporting the wafer W in the processing chamber 2; a gas supply mechanism 5A for supplying a gas into the processing chamber 2; a gas exhaust unit 6 for vacuum-evacuating the processing chamber 2; and a control unit 8 for controlling the respective components of the microwave heating apparatus 1A. The microwave heating apparatus 1A of the present embodiment is different from the microwave heating apparatus 1 of the first embodiment in the shape of the rectifying plate 23A of a gas supply mechanism 5A. Thus, in FIG. 10, components having substantially the same configuration and function as those in FIG. 1 are denoted by like reference characters, and thus the description thereof will be omitted. In FIG. 10, the loading/unloading port 12*a* and the gate valve GV are not illustrated.

In the present embodiment as well, the shower head 22 and the rectifying plate 23A of the gas supply mechanism 5A serve as partitioning portions for defining the bottom portion of the microwave radiation space S. Further, the microwave heating apparatus 1A includes the rectifying plate 23A having an inclined portion for reflecting microwaves toward the wafer W. In other words, the top surface of the rectifying plate 23A which surrounds the periphery of the wafer W is inclined so as to be widened from the wafer W side (inner side) toward the sidewall portions 12 side (outer side). The angle and the width of the inclined portion are uniform along the inner surfaces of the sidewall portions 12. The shower head 22 and the rectifying plat 23A are made of a metal, e.g., aluminum, aluminum alloy, stainless steel or the like.

In the present embodiment, in order to efficiently focus the microwaves on the center of the wafer W, the inclined portion of the rectifying plate 23A is provided to have a position $P_1$ higher than a reference position $P_0$ corresponding to the height of the wafer W and a position $P_2$ lower than the reference position $P_0$. Specifically, as shown in FIG. 11, the upper end of the inclined upper surface (the inclined portion) of the rectifying plate 23A is located at a position (the upper position $P_1$) upper than the wafer W supported by the supporting pins 14. Further, the lower end of the inclined upper surface (the inclined portion) of the rectifying plate 23A is located at a position (the lower position P2) lower the wafer W supported by the supporting pins 14.

In FIG. 11, the directions of the microwaves reflected by the inclined portion of the rectifying plate 23A are schematically indicated by electromagnetic vectors 100 and 101. The microwaves that have been scattered in the microwave radiation space S and moved downward, i.e., from the ceiling portion 11 of the processing chamber 2 toward the rectifying plate 23, can be reflected by the inclined portion and transmitted toward the center of the wafer W. Hence, the microwaves can be focused on the center of the wafer W. As a consequence, the heating efficiency can be increased by the reflected waves, and the entire surface of the wafer W can be uniformly heated.

The angle of the upper surface (the inclined portion) of the rectifying plate 23A may be randomly set as long as the microwaves radiated from the microwave introduction ports 10 can be effectively reflected toward the wafer W. Specifically, it may be properly set in consideration of the arrangement and the shape (e.g., the ratio $L_1/L_2$), the gap G and the like of the microwave introduction ports 10.

In the microwave heating apparatus 1A of the present embodiment, the inclined portion is provided at the rectifying plate 23A, so that the number of components can be reduced thereby simplifying the apparatus configuration compared to the case of providing the inclined portion as a separate member.

The other configurations and the effects of the microwave heating apparatus 1A of the present embodiment are the same as those of the microwave heating apparatus 1 of the first embodiment. Specifically, in the present embodiment, the four sidewall portions 12 of the processing chamber 2 are orthogonally connected to one another, and the four microwave introduction ports 10 are arranged in such a way that the long sides and the short sides thereof are in parallel to the inner surfaces of the four sidewall portions 12A to 12D. The four microwave introduction ports 10 are circumferentially located at positions spaced apart from each other at an interval of about 90° and arranged in such a way that each one of the microwave introduction ports 10 is not overlapped with another microwave introduction port 10 whose long sides are in parallel to the long sides of the long sides of the corresponding microwave introduction port 10 when the corresponding microwave introduction port 10 is moved in translation in a direction perpendicular to the long sides thereof. Further, two microwave introduction ports 10 that are not adjacent to each other among the four microwave introduction ports 10 are disposed such that the central axes AC thereof do not coincide with each other on the same straight line. Hence, the microwaves introduced from one of the microwave introduction ports 10 are prevented from entering the other microwave introduction ports 10.

In the present embodiment, in addition to such arrangement of the microwave introduction ports 10, an inclined portion is formed in the rectifying plate 23A in order to effectively focus the microwaves on the center of the wafer W. Accordingly, it is possible to focus the microwaves on the center of the wafer W while minimizing the loss of the microwaves radiated from the microwave introduction ports 10. As a result, the heating efficiency of the wafer W can be increased.

In the above embodiment, since the bottom of the microwave radiation space S is defined by the shower head 22 and the rectifying plate 23A of the gas supply mechanism 5A, the top surface of the rectifying plate 23 serves as the inclined portion. However, in the case of a microwave heating apparatus that does not have the shower head 22 and the rectifying plate 23A, an inclined portion may be provided at the bottom portion 13 of the processing chamber 2. In that case, a part of the inner wall of the bottom portion 13 may be inclined at a predetermined angle, or a separate member having an inclined portion may be provided on the bottom portion 13.

The inclined portion for reflecting microwaves is not necessarily provided at the lower portion of the microwave radiation space S and may be provided at the upper portion of the microwave radiation space S. For example, although it is not shown, the inclined portion may be formed by an angle between the ceiling portion 11 and the sidewall portions 12.

Third Embodiment

Figure 12:
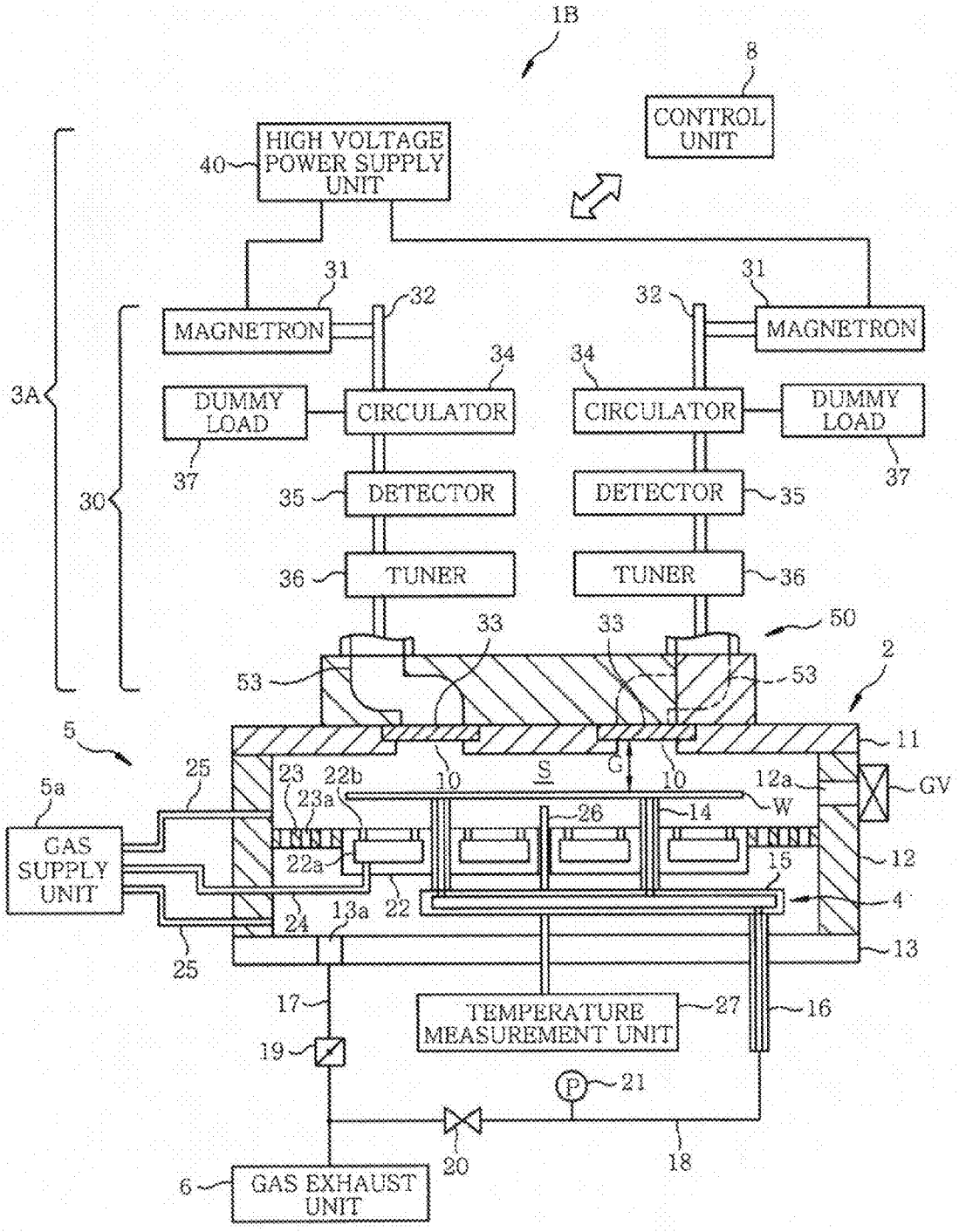
FIG. 12 is a cross sectional view showing a schematic configuration of a microwave heating apparatus in accordance with a third embodiment of the present invention.
Figure 13:
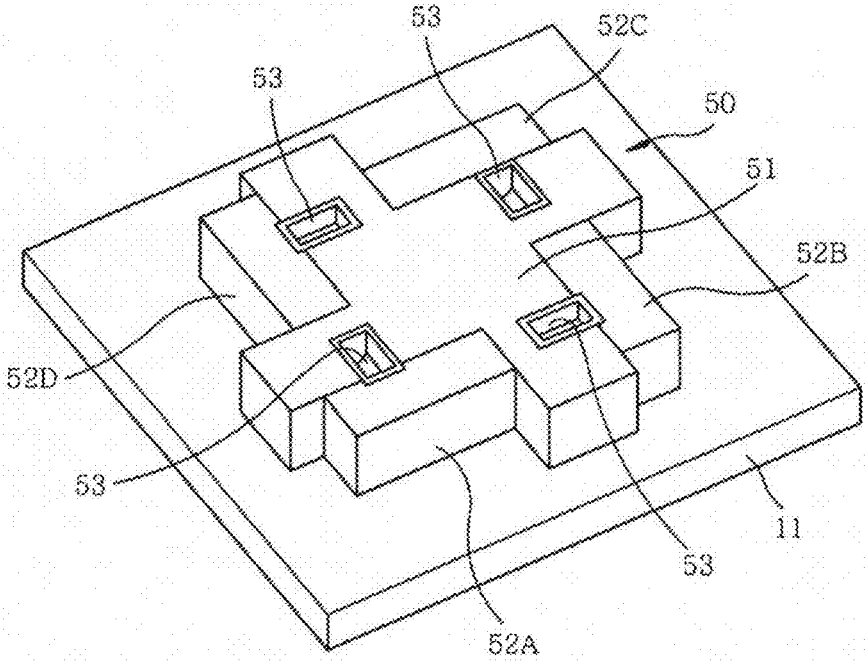
FIG. 13 explains a state in which a microwave introduction adaptor is attached to a ceiling portion.
Figure 14:
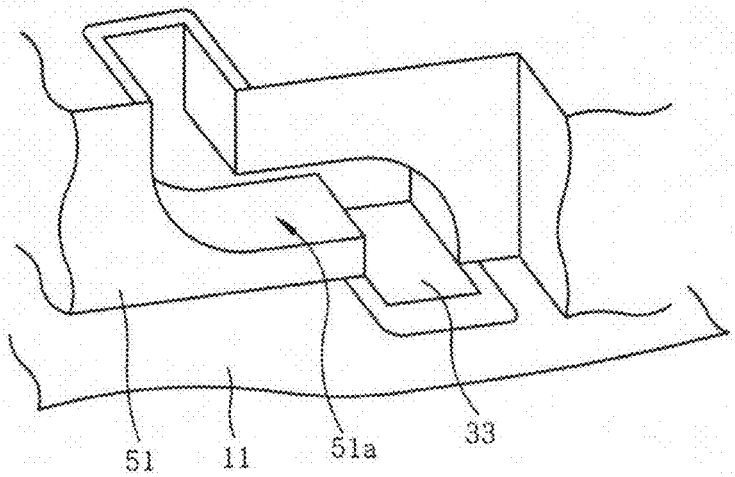
FIG. 14 explains a groove formed at the microwave introducing adaptor.

Hereinafter, a microwave heating apparatus in accordance with a third embodiment of the present invention will be described with reference to FIGS. 12 to 14. FIG. 12 is a cross sectional view showing a schematic configuration of a microwave heating apparatus 1B of the present embodiment. FIG. 13 explains a state in which a microwave introducing adaptor 50 serving as an adaptor member having a waveguide for transmitting microwaves is installed at the ceiling portion 11. FIG. 14 explains grooves formed at the microwave introducing adaptor 50.

The microwave heating apparatus 1B of the present embodiment performs annealing by radiating microwaves to the wafer W for manufacturing semiconductor devices through a plurality of consecutive operations. In the following description, the difference between the microwave heating apparatus 1B of the present embodiment and the microwave heating apparatus 1 of the first embodiment will be described. In the microwave heating apparatus 1B shown in FIGS. 12 to 14, components having substantially the same configuration and function as those in the microwave heating apparatus 1 of the first embodiment are denoted by like reference characters, and thus the description thereof will be omitted.

The microwave heating apparatus 1B includes a processing chamber 2 for accommodating a wafer W serving as a target object to be processed; a microwave introducing unit 3A for introducing the microwaves into the processing chamber 2; a supporting unit 4 for supporting the wafer W in the processing chamber 2; a gas supply mechanism 5 for supplying a gas into the processing chamber 2; a gas exhaust unit 6 for vacuum-evacuating the processing chamber 2, and a control unit 8 for controlling the respective components of the microwave heating apparatus 1B.

The microwave introducing unit 3A is provided above the processing chamber 2 to introduce electromagnetic waves (microwaves) into the processing chamber 2. As shown in FIG. 12, the microwave introducing unit 3A includes a plurality of microwave units 30 for introducing the microwaves into the processing chamber 2; a high voltage power supply unit connected to the microwave units 30; and a microwave introducing adaptor 50 connected between the waveguide 32 and the microwave introduction ports 10 to transmit the microwaves therebetween.

In the present embodiment, the microwave units 30 have the same configuration. Each of the microwave units 30 includes a magnetron 31 for generating microwaves for processing the wafer W; a waveguide 32 through which the microwaves generated by the magnetron 31 is transmitted to the processing chamber 2; and a transmitting window 33 fixed to the ceiling portion 11 so as to cover the microwave introduction ports 10. Each of the microwave units 30 further includes a circulator 34; a detector 35 and a tuner 36 which are provided on the waveguide 32; and a dummy load 37 connected to the circulator 34.

As shown in FIG. 13, the microwave introducing adaptor 50 is formed of a plurality of metallic block bodies. In other words, the microwave introducing adaptor 50 includes a single large central block 51 disposed at the center; and four auxiliary blocks 52A to 52D disposed around the central block 51. The block bodies are fixed to the ceiling portion 11 by a fixing unit, e.g., bolts or the like.

As shown in FIG. 14, the central block 51 has a plurality of grooves 51*a* formed at a side surface thereof. At the side surface of the central block 51, the grooves 51*a* are arranged from the top surface to the bottom surface of the central block 51 while forming a substantially S shape. The number of the grooves 51*a* corresponds to the number of the microwave units 30. In the present embodiment, four grooves 51*a* are formed.

The auxiliary blocks 52A to 52D are combined with the central block 51, thereby forming the microwave introducing adaptors 50. The auxiliary blocks 52A to 52D are arranged to correspond to the grooves 51*a* of the central block 51. In other words, each of the auxiliary blocks 52A to 52D is fixed to the side surface where the groves 51*a* of the central block 51 are formed. Further, an approximately S-shaped waveguide path 53 capable of transmitting microwaves therethrough is formed by blocking the openings of the grooves 51*a* at the side surface of the central block 51 by the auxiliary blocks 52A to 52D. In other words, the waveguide path 53 is formed by three walls in the grooves 51*a* and one wall of each of the auxiliary blocks 52A to 52D. The waveguide path 53 is a through hole extending from the top surface to the bottom surface of the microwave introducing adaptor 50.

The upper end of the waveguide path 53 is fixed to the lower end of the waveguide 32, and the lower end of the waveguide path 53 is connected to the transmitting window 33 for blocking the microwave introduction ports 10. The waveguide 32 is position-aligned with the waveguide path 53 and fixed to the microwave introducing adaptors 50 by a fixing unit, e.g., bolts or the like. The waveguide path 53 is formed in an S shape in order to reduce transmission loss of the microwaves and misalign positions of the waveguide 32 with the microwave introduction ports 10 in the horizontal direction. By combining a plurality of block bodies, the waveguide path 53 capable of minimizing transmission loss can be formed by a simple metal process.

In the microwave heating apparatus 1B of the present embodiment, the degree of freedom in the arrangement of the microwave units 30 and the microwave introduction ports 10 can be considerably increased by using the microwave introducing adaptors 50. In the microwave heating apparatus 1B, it is required to provide the components of the four microwave units 50 on the processing chamber 2. However, an installation space on the processing chamber 2 is limited. Thus, in the configuration in which the waveguide 32 is directly connected to the microwave introduction ports 10, the arrangement of the microwave introduction ports 10 may be limited by interference between the adjacent microwave units 30.

The configuration of the microwave introducing adaptors 50 used in the present embodiment may be flexibly selected by the S-shaped waveguide path 53 among the fixed arrangement in which the relative positions between the waveguide 32 and the microwave introduction ports 10 are overlapped with each other vertically, the arrangement in which they are not overlapped with each other vertically, and the arrangement in which they are partially not overlapped with each other (i.e., the arrangement in which they are misaligned horizontally). Therefore, by using the microwave introducing adaptors 50, the microwave introduction ports 10 can be provided at any portion of the ceiling portion 11 without being restricted to the installation space on the microwave unit 30. For example, when the four microwave introduction ports 11 are provided near the center of the ceiling portion 11, the interference between the microwave units 30 can be avoided by using the microwave introducing adaptors 50.

As described above, in the microwave heating apparatus 1B, the degree of freedom in the arrangement of the microwave introduction ports 50 is considerably increased by using the microwave introducing adaptors 50. Hence, in accordance with the microwave heating apparatus 1B of the present embodiment, the uniformity of the heating in the surface of the wafer W can be improved, thereby heating the wafer W uniformly.

The other configurations and the effects of the microwave heating apparatus 1B of the present embodiment are the same as those of the microwave heating apparatus 1 of the first embodiment, and thus the description thereof will be omitted. Further, the block body used in the microwave introducing adaptor 50 may have various shapes and sizes in accordance with the arrangement or the number of the microwave introduction ports 10. For example, the waveguide path may be formed by combining small block bodies such as the auxiliary blocks 52A to 52D without providing the central block 51.

In the present embodiment, the microwave introducing adaptor 50 is commonly used for each of the microwave units 30. However, a plurality of microwave introducing adaptors 50 may be provided for the microwave units 30, respectively. Further, the microwave introducing adaptor 50 may be included in the microwave units 30 as one of the components thereof. The microwave introducing adaptor 50 may be applied to the microwave heating apparatus 1A of the second embodiment.

The present invention may be variously modified without being limited to the above embodiments. For example, the microwave heating apparatus of the present invention is not limited to the case of using a semiconductor wafer as a target object to be processed and may also be applied to a microwave heating apparatus which uses as the target object a substrate for a solar cell panel or a substrate for a flat panel display, for example.

The number of the microwave units 30 (the magnetrons 31), the number of the microwave introduction ports 10, and the number of microwaves simultaneously introduced into the processing chamber 2 are not limited to those described in the above embodiments. For example, the microwave heating apparatus may include two or three microwave introduction ports 10, or may include five or more microwave introduction ports 10.

While the invention has been shown and described with respect to the embodiments, it will be understood by those skilled in the art that various changes and modifications may be made without departing from the scope of the invention as defined in the following claims.

What is claimed is:

1. A microwave heating apparatus comprising:

a processing chamber configured to accommodate a target object to be processed, the processing chamber having therein a microwave irradiation space; and a microwave introducing unit including four microwave sources that generate microwaves for heating the target object, wherein the processing chamber includes a top wall, a bottom wall, and four sidewalls connected to one another;

the top wall has four microwave introduction ports;

through each of the four microwave introduction ports the microwaves generated by a corresponding microwave source of the four microwave sources are introduced into the processing chamber;

each of the four microwave introduction ports is of a substantially rectangular shape having long sides and short sides in a plan view;

the four microwave introduction ports are arranged in such a way that the long sides and the short sides thereof are parallel to inner surfaces of the four sidewalls;

the four microwave introduction ports are circumferentially disposed at positions spaced apart from each other by angles of about 90°;

each one of the four microwave introduction ports has, from among the four microwave introduction ports, a corresponding microwave introduction port whose long sides are parallel to the long sides of said one of the four microwave introduction ports; and said one of the four microwave introduction ports is spaced apart from its corresponding microwave introduction port in a longitudinal direction that is parallel to the long sides of said one of the four microwave introduction ports, so as to not overlap any portion of its corresponding microwave introduction port in said longitudinal direction.

2. The microwave heating apparatus of claim 1, wherein a ratio $L_1/L_2$ between a long side $L_1$ and a short side $L_2$ of each of the microwave introduction ports is set to about 4 or more.

3. The microwave heating apparatus of claim 1, wherein each of the four microwave introduction ports has a central axis parallel to its long sides;

the four microwave introduction ports are arranged such that the central axis of each of the four microwave introduction ports is perpendicular to the central axes of two circumferentially adjacent microwave introduction ports; and the respective central axes of each of the four microwave introduction ports and its corresponding microwave introduction port are spaced apart from each other in a transverse direction that is perpendicular to the respective central axes, so that the respective central axes of each of the four microwave introduction ports and its corresponding microwave introduction port are not collinear.

4. The microwave heating apparatus of claim 1, wherein a microwave radiation space is defined by the top wall, the four sidewalls and a partition provided inside the processing chamber between the top wall and the bottom wall, and an inclined portion for reflecting the microwaves toward the target object is provided at the partition.

5. The microwave heating apparatus of claim 4, wherein the inclined portion has an inclined surface having a position higher than a reference position corresponding to the height of the target object and a position lower than the reference position, and is disposed to surround the target object.

6. The microwave heating apparatus of claim 1, wherein the microwave introducing unit includes:

one or more waveguides through which the microwaves are transmitted toward the processing chamber; and one or more adaptor members attached to an outer side of the top wall of the processing chamber, each of the adaptor members being formed of a plurality of metallic block bodies, wherein each of the adaptor members includes therein a substantially S-shaped waveguide path through which the microwaves are transmitted.

7. The microwave heating apparatus of claim 6, wherein each of the waveguide paths has one end connected to the one or more waveguides and another end connected to one of the four microwave introduction ports; and at least one of the one or more waveguides is horizontally displaced relative to a microwave introduction port to which it is connected by a waveguide path of the one or more adaptor members such that the one or more waveguides are not vertically overlapped with at least a portion of the microwave introduction ports.

8. A processing method for heating a target object to be processed, comprising:

providing a processing chamber configured to accommodate a target object to be processed, the processing chamber having therein a microwave irradiation space;

providing a microwave introducing unit including four microwave sources that generate microwaves for heating the target object, wherein the processing chamber includes a top wall, a bottom wall, and four sidewalls connected to one another;

the top wall has four microwave introduction ports;

each of the four microwave introduction ports is of a substantially rectangular shape having long sides and short sides in a plan view;

the four microwave introduction ports are arranged in such a way that the long sides and the short sides thereof are parallel to inner surfaces of the four sidewalls;

the four microwave introduction ports are circumferentially disposed at positions spaced apart from each other by angles of about 90°;

each one of the four microwave introduction ports has, from among the four microwave introduction ports, a corresponding microwave introduction port whose long sides are parallel to the long sides of said one of the four microwave introduction ports; and said one of the four microwave introduction ports is spaced apart from its corresponding microwave introduction port in a longitudinal direction that is parallel to the long sides of said one of the four microwave introduction ports, so as to not overlap any portion of its corresponding microwave introduction port in said longitudinal direction; and introducing the microwaves into the processing chamber through the microwave introduction ports to thereby process the target object by heating the target object by the microwaves.

9. The microwave heating apparatus of claim 4, wherein the partition has a plurality of openings vertically extending through the partition.

* * * * *